US006633740B2

(12) United States Patent
Estabrooks

(10) Patent No.: US 6,633,740 B2
(45) Date of Patent: Oct. 14, 2003

(54) ON DEMAND MEDIA WEB ELECTROPHOTOGRAPHIC PRINTING APPARATUS

(76) Inventor: David Allen Estabrooks, P.O. Box 519, New Buryport, MA (US) 01950

( * ) Notice: Subject to any disclaimer, the term of this patent is extended or adjusted under 35 U.S.C. 154(b) by 0 days.

(21) Appl. No.: 09/777,502

(22) Filed: Feb. 5, 2001

(65) Prior Publication Data

US 2003/0035671 A1 Feb. 20, 2003

Related U.S. Application Data

(60) Provisional application No. 60/180,082, filed on Feb. 3, 2000.

(51) Int. Cl.[7] ..... G03G 15/00

(52) U.S. Cl. ..... 399/384; 399/385; 399/394; 399/299

(58) Field of Search ..... 399/299, 384, 399/394, 395, 385, 121, 112, 389, 301, 302; 101/224, 226, 227; 226/2, 27, 45; 347/16, 104, 139, 153, 218, 219, 262, 264, 115, 232

(56) References Cited

U.S. PATENT DOCUMENTS 3,639,053 A * 2/1972 Spear, Jr. ..... 399/385
3,882,744 A * 5/1975 McCarroll ..... 83/262
3,951,023 A * 4/1976 Ashburner ..... 226/113
4,639,749 A * 1/1987 Ito ..... 101/DIG. 37
4,897,677 A * 1/1990 Lai ..... 347/119
4,935,788 A * 6/1990 Fantuzzo et al. ..... 399/299
5,008,710 A * 4/1991 Kobayashi et al. ..... 101/228
5,041,850 A * 8/1991 Kahoyashi et al. ..... 347/157
5,189,470 A * 2/1993 Matsuda et al. ..... 346/136
5,192,141 A * 3/1993 Chung et al. ..... 271/111
5,274,428 A * 12/1993 Wong et al. ..... 347/115
5,555,078 A * 9/1996 Iwama et al. ..... 347/138
5,708,345 A * 1/1998 Kramer et al. ..... 271/258.01
5,768,675 A * 6/1998 Estabrooks ..... 101/224
5,808,646 A * 9/1998 Kitahara et al. ..... 347/104

* cited by examiner

*Primary Examiner*—Robert Beatty

(57) ABSTRACT

The present invention is an improved compact media web electrophotographic printer including photographic full-color, and an automatic web feeding and cutting registration apparatus and method for media web and closely spaced short printouts. This apparatus comprises an improved media web-handling unit for feeding from a recording roll, and an improved sensing system for sensing a buckle and for precisely cutting the short printout at a desired controlled length, and includes an automatic setup prior to each print cycle. In addition a color serial printer having equiangularly arranged process cartridge units movable along guide rails and which is parallel to a common transfer roll which is also seperately movable along guide rails is disclosed.

59 Claims, 19 Drawing Sheets

ON DEMAND MEDIA WEB ELECTROPHOTOGRAPHIC PRINTING APPARATUS

CROSS REFERENCES TO RELATED APPLICATIONS

U.S. Provisional Patent Application No. 60/180,082 dated Feb. 3, 2000.

BACKGROUND

1. Field of Invention

This invention is an improved on demand media web electrophotographic printer with a feeding and cutting registration apparatus, including a method that reliably monitors and controls consistent media web feeding, registration, and the cutting of the web by utilizing a sensor system that includes a web buckle sensor to form a precise web buckle prior to each feeding and cutting. Utilizing a gap or indicia sensor, the processor accurately positions media, including media edges and performs a unique, more productive; automatic on-line operating setup of the media web with the cutting of each desired length. An improved initial setup of the roll of plain media, including adhesive backed media web spaced on a "backer" roll for minimizing downtime and media wastage.

2. Description of Prior Art

On demand prior art printer apparatus, such as thermal transfer, address the technical problem of maintaining media web feeding and accurate printing without wastage by integrating into the apparatus, complex sensing and web compensation means, with the cutting of the web following printing. This thermal printer cutting method does not aid in the on line maintaining of the accuracy of registration. With thermal transfer, the printer automatic sensing and compensation means may frequently stop the printing operation to off-line adjust the media web and to more accurately position the media leading edge and media gap or indicia prior to printing. This level of complexity requires additional downtime for the operating setup of media printing which increases cost, lowers productivity, and reduces reliability. Also, there is much more downtime in the frequent changing of low capacity, high cost thermal media ribbons at greater expense than the electrophotographic (EP) printer high capacity toner cartridge of the present invention.

The present invention relates to the industrial marking market and the kind of on demand printer that generally uses media web special Printouts or non-standard sheet sizes, as opposed to the office document printers and copiers, which use a series of standard sheet sizes starting with 8.5"×11". Industrial marking media web Printouts vary in length and width for text information and images related to transactions, data, identification, and includes photos, barcodes, labels, tags, tickets, narrow web receipts, and the like. Industrial marking also includes special cut sheet sizes for color labels, airline tickets, RFID tags, ID cards with photos, credit cards, and the like. These special cut sheet sizes may be web cut, and they may be web processed or separately handled in cut sheet feeders and stackers. The completed Printouts may be laminated in clear plastic. Industrial marking Printouts include "spot colors" or full-color, i.e. yellow, magenta, cyan, and black.

On demand prior art industrial marking printers such as thermal transfer media web printers are designed to operate with a variety of media types, including pressure sensitive, die-cut, butt-cut, or stock media web. The type of media sensors the printer has, dictates its ability to operate with certain media types. Unless the media is a plain continuous web, die cuts, black marks, or notches help the printer determine the top of the media.

Thermal transfer printers come equipped with a variety of media sensors that enable the printer to gauge fixed vertical media length during the media calibration process. Automatic Off Line Calibration is a process that is typically performed by a web thermal transfer media printer in order to gauge the length of the media material loaded within it and compensate for error build up from repeated print cycles. Sensors within the printer's media compartment—commonly located around the thermal printhead—detect either the white spaces (inter-media gaps) or black marks and/or notches on the reverse side of the media stock that represent a media's actual face size (length). Printer calibration ensures that the data is aligned and prints correctly on the media stock and is also cut correctly at the media gap or indicia after printing. The printer media sensors of the prior art may frequently stop printing to recalibrate off-line, resulting in excessive downtime and wasted media.

Prior art media web thermal printers are configured to contain any one of the below sensor varieties:

- Transmissive Media Sensor is used to gauge media length for media with visible inter media gaps, notches, or pre-punched holes, or plain continuous media
- Reflective Media Sensor is a reflective sensor emits light, which is reflected back to the sensor when it reaches an indicia or black mark.
- Dual Media Sensors are two sensors within the printer (one reflective and one transmissive) that have the ability to detect both inter media gap and black mark media.
- Multi-functional Sensor refers to a single sensor within the printer that has the ability to detect both inter media gap and black mark media, irrespectively.

EP printers are excellent at printing the highest quality bar code Media Web, text and graphics on plain paper media. Bar code density is also quite high on EP printers resulting in a scannable code at virtually any wavelength using an infrared scanner. However, widely used standard laser office page printers are not well suited for industrial media web applications. Here, they prove inadequate and wasteful, as it is impossible to produce single or small media lengths. (A minimum of at least ½ standard page of media is typically. required for the printer apparatus nips to maintain feeding control of the sheet. Unless the media is at least that size, the remainder is wasted). Since EP printers have been developed to process relatively long cut sheets, and continuous web EP applications tend to waste media when starting and stopping, electrophotographic technology has not been widely used for media web printing. In addition, the conventional EP apparatus (unlike the small footprint Media Web EP printer with very short media length capability of the present invention) has been developed with an inherently long media path of operating nips of subassemblies to accomplish the processes of latent imaging, toning, transfer, and fusing. A certain minimum length of the web is necessary to engage the nips of these prior art process units in order that a driving relationship in the printer is maintained. With current electrophotographic (EP) methods, the minimum length of a media sheet is limited by the allowable configuration, location or spacing of the nips between these operating subassemblies of the printer. As a result attempting to cut the media after the media is printed and is being ejected results in an overly long margin and waste of media.

Since EP printers have mechanically spread apart, functions of latent imaging, toning, and fusing, their web feeding and cutting apparatus must include means such as a web buckle of the media at the cutter to allow a clean severing of the stationary media, during the process of printing with precisely controlled leading and trailing edges without media wastage. However, unconstrained web feeding can result in an over size buckle causing a media jam. And, an undersize buckle does not allow enough time for a clean cut, resulting in irregular tearing and jamming of the media. Rapid printer response is required in most on demand applications, and it is desirable to have the web buckle formed ready for the print command. However, over a prolonged standby period, a permanent set of the web buckle may occur causing a media jam at the start of the next print cycle. These conditions are made worse by variations in the thickness and stiffness of the media.

The media web EP prior art discloses a web buckle accumulation apparatus and method for the control of the web unidirectional feeding and cutting during the printing process. EP web printers U.S. Pat. No. 3,639,053, and U.S. Pat. No. 5,768,675 disclose a web buckle accumulation method. With this method, the media web EP registration roll feed unit advances the web in an accurately timed relationship with the EP imaging unit, which may move slower than the media feed roll unit to accumulate a buckle between the two roll feed units. Dictated by the processor, on stopping the media feed roll unit at the desired length Printout, ahead of the EP imaging unit, the cutter cleanly severs the media web. The buckle flattens as the registration roll unit continues to feed the balance of the cut desired length through the latent imaging, developing, and fusing units of the EP printer. The cut defines the trailing edge of the desired media length and a new leading edge for the next print cycle. The processor controls the media printing, feeding and cutting to reduce media waste.

Another EP printer web feeding and cutting U.S. Pat. No. 5,708,345 has disclosed the use of a web buckle sensor to switch a motor from a feeding to a cutting mode. The web buckle is accumulated with a speed difference between two drivers of the EP Printer.

U.S. Pat. No. 4,025,187 discloses in a sheet fed EP printer, a cut sheet buckle that is formed rather than accumulated. The cut sheet buckle forming is controlled with digital clock reference time to obtain consistent skew removal and sheet separation from the cassette. The forming of the buckle is done by feeding the cut sheet forward to a stop, sensing the sheet leading edge, then feeding forward a set time interval to form the desired length buckle against the stop. No buckle sensor is applied to detect the buckle shape or size. The reference feeding time is made sufficient to form the desired buckle for the sole purpose of eliminating skew. The feeding time is adjustable for forming the buckle in order to take into account the slippage between the feeder and the sheet, and any error in the position of the leading edge of the sheet at the start of feed.

Another EP cut sheet printer disclosed in U.S. Pat. No. 3,241,831 forms a buckle against a stop under the control of a buckle sensor. After the appropriate buckle height is sensed the sheet is then fed in a conventional manner. Another U.S. Pat. No. 3,335,662 discloses the leading edge of the cut sheet buckle formed of a desired size against a fixed stop, as detected by a photoelectric sensor, or proximity sensor, starting the print cycle.

The prior art EP apparatus and methods do not teach, relate to or address the solutions required and the specialized needs of on demand small printers used in industrial marking, including high productivity, compact on demand media web label and transaction printing without wasting recording media, which historically has been a distinct development form EP office and document printers. It will be apparent from the Description of the Invention that the apparatus, methods, sensor system and control combinations required of the present EP invention discloses unique apparatus and methods for compact on demand EP printing, feeding and cutting that conserves media, lowers cost, and enhances productivity have not been anticipated by the prior art.

The on demand media web EP prior art does not disclose an improved media web registration apparatus and method for consistent precise registration for accurate media web feeding and locating of the desired media length leading edge; a sensor system with feedback to a processor that more effectively controls the imaging, printing, and the cutting web desired length prior to the completion of printing. In addition, the prior art does include an initial automatic setup of the media roll, followed by an on line operating'setup included in each print cycle that maintains the consistent quality of Printouts without downtime, thereby further increasing productivity, reducing cost and eliminating media wastage. The EP printer of the present invention discloses all have the above new apparatus and methods including full color EP printing.

Higher resolution (a finer dot size and increased dots per inch) is required to facilitate the printing of text, such as six point, and bar codes on small or miniaturized label media, such as commonly used in the electronics of pharmaceutical industries for component or specimen labels. The higher print resolution of the EP printer enable more detailed media (often highly miniaturized and compact) to be accomplished without impairing print quality and scanner readability. The Media Web Electrophotgraphic (EP) Printer has the advantage of superior photographic print quality with a much finer dot size or dot acuity, full-color graphics capability, with permanent print on plain media with the highest abrasive resistance. The new Media Web Electrophotgraphic (EP) Printer is significantly lower in media cost than direct thermal media, and a much higher capacity EP toner cartridge at lower cost with a lower frequency of replacement than printers such as impact ribbon, thermal transfer ribbon, and ink jet cartridge.

SUMMARY OF THE INVENTION

EP printer operation of the present invention takes place with an electronic processor, which includes a formatter and a controller. With a print command the formatter receives the print information from the interface with the host terminal based on the host protocol, and determines the printed output for the printer controller including the desired media length prior to printing. The formatter instantly translates the print information with commands for the controller to process the imaging, and to cut the media to the desired length. Instructed by the formatter on a print command from the host, the controller engages the registration rolls with a clutch to the main stepper motor. A synchronization sensor is located after and immediately adjacent to the nip between the registration rolls and at a predetermined fixed distance from the nip between the transfer roll and photosensitive drum. A registration roll nip sensor detects the leading edge of the media web at the nip between the registration rolls before forming the web buckle prior to the print operation. The web buckle is formed by a registration web guide is detected by a web buckle sensor. During printer operation and prior to cutting, the speed of the image processing registration rolls and media feed rolls are synchronized at the same speed to maintain the accurate web buckle formed before the start of the print cycle.

The laser diode beam scans the rotating photosensitive drum, or rotary image carrier, followed by the toned image on the drum. The point of image transfer to the media web is precisely at the nip between the transfer roll and photosensitive drum. As the toned image is transferred to the media web from the drum at the drum/transfer roll nip, the printed web is advanced through the fixing unit. The fixing of the toned image takes place between the nip of the fuser roll and the pressure roll of the fuser unit. The controller tracks the feeding of the media web until the length remaining of the total media desired length Printout determined by the formatter, equals the fixed distance from the synchronization sensor to the cutter. At this point, the controller stops the media feed unit and the media web ahead of the media feed rolls, is severed cleanly from the media roll by the cutter creating the desired length trailing edge, as the controlled web buckle flattens.

After the media feed unit is stopped and the cutter is actuated, the registration roll clutch remains engaged feeding the balance of the severed media through the EP printing unit until the synchronization sensor, signals the controller that the end of the media has passed the sensor. The image scanner stops after the media has traveled the required distance from the sensor to meet the end of print at the nip of the photosensitive drum and transfer roll. The main stepper motor continues to operate the imaging unit until the fuser exit sensor detects the trailing end of the media.

Once the trailing edge of the desired length Printout passes the synchronization sensor, the new web buckle may be formed between the cutter and the stopped registration roll nip by the media feed rolls. The imaging unit finishes the printing as the remainder of the desired length Printout is fed through the printer. While printing continues, the media feed rolls feed the media web leading edge forward the desired distance and length and then may form the accurate web buckle with the stopped upper registration roll and the registration web guide as ordered by the formatter and exercised by the controller for the each print job. Each time media web, or a group of media such as labels on a web backer, is printed and cut, the formatter instructs the controller to feed the web leading edge to the nip between the registration rolls to be made ready for the next print command.

The media feed rolls may be operated by the main printer motor through a clutch, or operated by a separate media feed roll motor, at the same drive speed as the printing process including registration rollers. In effect, the controller with single drive main motor clock synchronized with the image scanner simultaneously drives the web constantly with a first and second driver. The drives operate at the same time at the same speed to move the web except on web buckle setup at each Printout (registration driver stopped), and when cutting the web (media feed driver stopped).

The present invention relates to an improved Media Web Electrophotographic (EP) Printer, including an enhanced web feeding and cutting apparatus and method, which has a built-in accuracy renewal capability, utilizing a novel sensing system including a web buckle. Unlike the thermal printer and the EP prior art, the present invention provides the operating setup of the media web leading edge with a media gap or indicia sensor for accurate Registration while printing continues to take place, included in the normal online printer operation to enhance throughput and productivity.

It is desired that these kinds of printers and apparatus perform rapidly and reliably with unattended operation in terminals and the like, over an extended period of time. Therefore, the present invention to avoid the above limitations comprises feedback sensors included with the web feeding and cutting apparatus, and a processor to reliably form and maintain a precise adequate web buckle on demand in unattended operation. Each time a media is cut, the printer automatically on-line recalibrates and positions the leading edge of the web for the next print command, maintaining Registration accuracy without downtime and wasted media web.

Advantages of the new EP printer over thermal transfer and other comparable technologies include:

- High contrast, crisp image bar code print quality with a durable, long-life and archival image stability with higher dot acuity and better abrasive resistance.
- Improved batch or individual media print capability—without waste and downtime.
- Lower, long-term maintenance, media and consumables cost.

To achieve the foregoing and other objects and in accordance with the purpose of the present invention, according to one aspect of this invention, a preferred compact electrophotographic printing apparatus including a print processor including a controller and a formatter containing sufficient memory for adequate image information to format the data to print the completed media. The formatter provides the Printout to the printer controller for each media of the desired length Printout for each print command from a host terminal.

The fast printing capability of laser and LED apparatus, allows the information to be held in the printer formatter memory for a correct total Printout, or an end of file command. Thus, the printer formatter, instantly communicating with the host terminal through a bi-directional interface, determines the complete media before printing starts with the controller. The printer formatter obtains the print job and separates it into efficient image formation to conserve media and instructions to control the printing process. For media web the formatter determines the complete desired length Printout from the host prior to the start of its hardcopy output. In summary, the formatter receives and processes the print data from the terminal or host interface, then develops and coordinates data placement and timing with the printer engine controller. The controller receives from the formatter, the information and data in the form that it needs to operate the printer. The controller then immediately synchronizes the image formation system with toning, fusing, and media feeding systems, including web cutting. The controller when ready, then signals the formatter to send the print image data.

Formatting time is the time required to convert the program to an image on the media. Depending on the complexity and size of the barcode media format and the printer's ability to process this information in an efficient manner, media-formatting time can sometimes cause a delay in printing, affecting a printer's overall print speed capability. Such delays can be annoying as well as costly if they occur in a production environment where time and on-demand print capability are of the essence. They must begin printing the desired media image even before the media format processing is complete. However, the formatter instantly receives the complete media data from the host with all of the information to be printed at the desired media length, before interacting with the controller to cause printing and cutting to take place, and allows the host instantly check the media information for accuracy and make corrections, before printing the complete media. The timing control of the present invention is accomplished in the same manner, but with a more productive and cost effective method of on line calibration of media web with accurate, reliable web feeding and cutting.

A novel serial full color EP printhead of the present invention provides fast color printing of the media web. Furthermore, a novel media web traversing serial full color EP printhead, compared to the prior art traversing serial full color ink jet, has a much wider print image width of the traversing print scan. The fewer scan passes of the traversing serial EP printhead of the present invention complete a document more rapidly, in the order of ten times faster. This traversing serial EP printhead capability also allows both narrow and wide format graphics printing of large page sizes in all four colors, yellow, magenta, cyan, and black serially at lower cost of toner consumables.

This improved on demand Media Web Electrophotographic (EP) Printer includes a Registration apparatus that monitors and controls accurate web feeding, cutting and locating of the web desired length printout leading and trailing edges for printing. The improved EP printer also detects media gaps or indicia, determines media spacing and Registration, and defines a controlled minimum length web buckle with a sensing means that forms the precise buckle prior to feeding and cutting. Additionally, the present invention also includes a process of on line operating setup and control of the feeding and cutting apparatus to assure a repeatable and reliable media printing operation to reduce downtime and minimize wastage. Furthermore, the improvement synchronizes the registration and feed rolls, in combination with the simple sensing means, allowing for control of the media web by forming the precise web buckle repeatedly and reliably after cutting on line, and during a media web feed operating setup procedure with the registration rolls stopped. The new and improved registration apparatus provides a unique, rapid thru-put, cost-effective module for laser or LED printing technology, but is adaptable as well to other printers such as direct thermal, thermal transfer, and ink jet.

The present invention has solved the minimum media and length limitations of electrophotographic printers and provides a unique, cost-effective small footprint laser or LED printing apparatus for continuous media web printing with a rapid, reliable, and simple method of feeding and severing the web desired length printout prior to the completion of EP printing.

OBJECTS AND ADVANTAGES

It is therefore a primary object of the present invention to provide an improved, more reliable media web feeding and cutting apparatus with feedback, which repeatedly forms an optimum and repeatable web buckle for more accurate synchronization of the printing and cutting of the media web.

It is a further object of this invention to provide a more reliable web feeding and cutting apparatus, which repeatedly senses the web leading edge at a registration roll nip, pre-forms an accurate and optimum web buckle prior to printing utilizing a pivoting registration web guide in conjunction with a web buckle sensor.

It is a further object of this invention to provide an improved on line operating setup in the normal operating sequence of the printing process to enhance productivity by saving the prior art additional downtime off-line of the printing process to accomplish the setup of the media web for accurate registration.

It is a further object of this invention to provide accuracy of web feeding and cutting to consistently or repeatedly obtain an accurate desired length printout.

It is a further object of this invention to provide accuracy of web feeding and cutting utilizing narrow and standard media web and media sensors.

It is a further object of this invention to provide consistent feeding and cutting with an optimum but minimum web buckle, whereby the desired length cannot flip back, and interfere with the next media, tending to cause a media jam during feeding.

It is a further object of this invention to provide improved monitoring and control of the web buckle with a web buckle sensor before the latent imaging unit whereby the media web is in accurate and repeatable registration for printing and cutting.

It is a further object of this invention to provide an optimized apparatus and method for monitoring and controlling feeding and cutting for the differences in media characteristics.

It is a further object of this invention to provide a method that avoids maintaining a web buckle for a prolonged period that may cause a permanent set in media stock that may cause a possible media jam.

It is therefore a primary object of the present invention to provide a printing apparatus and method, with a high cartridge capacity, and a low cost of consumables.

It is another object of this invention to provide a printing apparatus with an improved processor with a sensor system that provides effective feedback and consistently controls the media desired length.

It is another object of this invention to provide a small, narrow and standard format EP printing apparatus, which accurately controls, prints and dispenses short, closely spaced media web.

It is a further object of this invention to provide a high print quality apparatus, which is designed to occupy a very small footprint area as a palm size printer for portable and wireless terminal applications.

It is a further object of this invention to provide a more reliable media web printing apparatus which images the input data, transfers the image to the recording medium, fuses the toner image, stops the recording medium roll, and automatically cuts the media web to any desired length.

It is a further object of this invention to provide an on demand compact narrow format printer for portable and wireless applications, which is designed to accept various media including cut plastic sheets, and smart cards as well as specialty paper.

It is a further object of this invention to provide an on demand narrow format fullcolor laser or LED printhead, which is designed to accept various media such as both narrow and wide media web roll, continuous forms, cut sheets and card stock for packaging, including transactions and barcode labels.

It is a further object of this invention to provide an on demand full-color printer whereby a laser or LED serial printhead transverses the media web, and which is designed to accept various media such as both narrow and wide media web roll, continuous forms, cut sheets and card stock for packaging, including transactions and barcode labels.

It is a further object of this invention to provide an on demand laser or LED printer with a high speed flash fuser which is designed to accept various media such as both narrow and wide media web roll, continuous forms, cut sheets and card stock for packaging, including transactions and barcode labels.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

REFERENCE NUMERALS

5 Flash Fuser Apparatus
6 Registration Apparatus
7 Compact Electrophotographic (EP) Full Color Imaging Apparatus
8 Compact Electrophotographic (EP) Imaging Apparatus
9 Full Color Serial Traversing Electrophotographic (EP) Printing Apparatus
10 Media Feed Roll
11 Media Feed Stepper Motor
12 Lower Media Feed Roll
13 Upper Media Feed Roll
14 Media Feed Sensor
15 Knife
16 Anvil
17 Web Buckle Sensor
18 Lower Registration Roll
19 Upper Registration Roll
20 Print Synchronization Sensor
21 High Capacity Toner Cartridge
21Y Yellow Toner Cartridge
21 M Magenta Toner Cartridge
21C Cyan Toner Cartridge
21 B Black Toner Cartridge
22 Toner Paddle
23 Developer Roll Unit
24 LED or Laser Scanner Unit
25 Photosensitive Drum
26 Image Transfer Roll Unit
26A Recording Transfer Roll
27 Main Stepper Motor
28 Pre-Imaging Charger Roll Unit
29 Discharging Roll & Cleaning Unit
30 Toner Fuser Roll
31 Pressure Roll
32 Printout Exit Sensor
33 Media Web
34 Media Vacuum Peeling Roll
35 Backer Vacuum Peeling Roll
36 Image Writing Line
37 Web Buckle
38 Photosensitive Drum/Transfer Roll Nip
38A Transfer/Recording Roll Nip
39 Media Web Leading Edge
40 Registration Roll Nip Sensor, or "Paper Out" Sensor
41 Media Feed Roll Nip
42 Registration Web Guide
43 Registration Roll Nip
45 Desired Length Printout
47 Media Gap
51 Processor
53 Closed-Loop Control System Circuit
55 Registration Roll Clutch
59 Registration Roll Feed Unit
61 Timing Belt
63 Cutter
65 Media Label
67 Media Feed Roll Unit
69 Desired Length Trailing Edge
71 Backer
75 Media Feed Roll Clutch
77 Printer Apparatus
81 Toner Fuser Roll Nip
82 Full Color EP Serial Printhead
84 Transverse Color Cartridge Drive
85 Pressure Roll Fuser
86 Transverse Color Fuser
87 Left Carriage Transport Shaft
88 Right Carriage Transport Shaft
90 Flash Lamp Power Supply
91 Flash Fuser Unit
92 Trigger

94 Optical Energy Sensor
95 Xenon Flash Lamp
98 Upper Lamp Reflector
99 Lower Lamp Reflector
100 Transfer/Fuser Unit
101 Serial Color Carriage
102 Left Transport Transfer Shaft
104 Right Transport Transfer Shaft
106 Color Imaging Paper Feed Motor
107 Upper Transport Media Feed Roller
108 Lower Transport Media Feed Roller The invention being thus described and illustrated, variations, modifications and equivalents will occur to those skilled in the art, and all these variations, modifications and equivalents are, intended to be within the scope of the invention, which is defined by the claims appended hereto.

PREFERRED EMBODIMENT—DESCRIPTION

Figure 1:
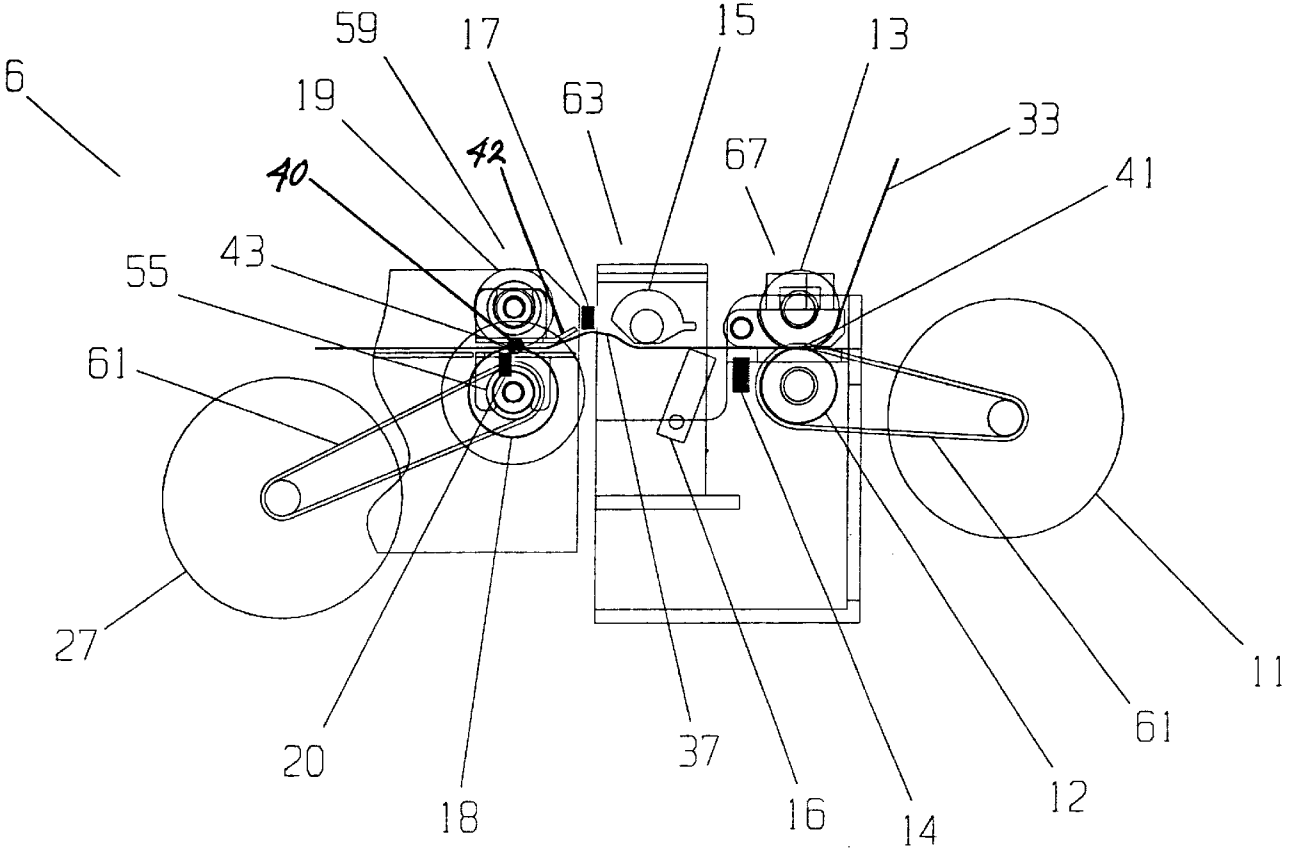
FIG. 1 is a view of the preferred Registration Apparatus for a Media Web Printer.

The improved Registration Apparatus 6 is shown in FIG. 1. The Media Feed Stepper Motor 11 is connected by Timing Belt 61, or the like, to the Lower Media Feed Roll 12 of the Media Feed Roll Unit 67. The Lower Media Feed Roll 12 is in spring-loaded (not shown) engagement with the Upper Media Feed Roll 13 to form a Media Feed Roll Nip 41 gripping the Media Web 33, in a channel with lateral media edge guides (not shown), extending from the Media Feed Roll 10 (See FIG. 3). The Media Web 33 extends beyond a Media Feed Sensor 14 to the Cutter 63 comprising a Knife Edge 15 and an Anvil 16, or other known cutter unit. The Cutter 63 is located between the Media Feed Roll Unit 67 and the Registration Roll Feed Unit 59. The Main Stepper Motor 27 is connected by the Timing Belt 61 to a Registration Roll Clutch 55 connected to the Lower Registration Roll 18 of the Registration Roll Feed Unit 59. The Lower Registration Roll 18 is in spring-loaded engagement with the Upper Registration Roll 19 to form a Registration Roll Nip 43 gripping the Media Web 33. Located at the Nip 43 is a Registration Roll NipoSensor 40 for detecting the Media Web Leading Edge 39.

The On Line Operating Setup (see FIGS. 7 & 8) is cleared to start when the previous Desired Length Trailing Edge 69 has cleared the Synchronization Sensor 20 and the Registration Roll Feed Unit 59 has stopped. The Processor 51 commands the Media Feed Roll Unit 67 driven in motor steps by the Media Feed Stepper Motor 11 to advance the Media Web Leading Edge 39 to the stopped Registration Roll Feed Unit 67, whereby the Edge 39 is detected and stopped at the Nip 43 by the Registration Roll Nip Sensor 40. With the Media Web Leading Edge 39 positioned correctly at the stopped Registration Roll Nip 43, the Media Feed Roll Unit 67 as determined by the Processor 51 feeds the Media Web Leading Edge 39 against the stopped Upper Registration Roll 19 and the Registration Web Guide 42 to form the Web Buckle 37 with buckle length P. The buckle length P, controlled by the Web Buckle Sensor 17, is necessary to allow time for the cutting process to take place with a clean cut, but small enough to avoid media feed jams. The Registration Web Guide 42 guides in the forming of the Web Buckle 37 in the process of coming into contact with, or in the proximity of, the Web Buckle Sensor 17 located at the end of the Guide 42. The Web Buckle Sensor 17 provides feedback to the Processor 51, confirming that the Web Buckle 37 is precisely formed with a buckle length P (See FIG. 5), thereby assuring that the EP Imaging Apparatus 8 (see FIG. 3) is ready to start a print cycle. At the start of the print cycle, or a print command, the Processor 51 advances the Media Web Leading Edge 39 beyond the Registration Roll Feed Unit 59 and Synchronization Sensor 20 into the novel Compact Media EP Imaging Apparatus 8 including the Registration Apparatus to comprise the complete Media Web Printer Apparatus 77 (see FIG. 3). Synchronization Sensor 20, located just after the Registration Roll Feed Unit 59 to detect the presence of the Media Leading Edge 39 passing the Registration Roll Nip 43, signals the Processor 51 to start LED or Laser Scanner Unit 24 scanning Imaging Line 36 on Photosensitive Drum 25. The Web Buckle 37 is flattened down with the Registration Roll Feed Unit 59 operating synchronously with the LED or Laser Scanner Unit 24 to print during the web cutting process.

The new unidirectional control of Media Feed Roll Unit 67 with Media Feed Stepper Motor 11 works in conjunction with the new Media Feed Sensor 14 detecting the Media Gap 47 between Media Label 65, which may be adhered to a Backer 71. In this case, the Backer 71 constitutes the Media Feed Roll 10 holding Media Label 65. Various types of sensors may be provided for the Media Feed Sensor 14 such as a Piezoelectric Sensor, detecting the thickness difference between the Media Gap 47 and Media Label 65, or a see-through Transmissive Media Pitch Sensor for use with a transparent backer, or a Reflective Media Pitch Sensor for use with Media Web that have a repeating I-mark with a pitch distance on the rear of the backing media. The reflective method of gap detection may be provided, used with desired black mark, or indicia preprinted on plain media or the backer at the gap between the Media Web to locate the Media Gap 47 with the Media Feed Sensor 14. A continuous web of media material may be provided with indicia preprinted on the Backer 71 or other marking arrangement of the Desired Length Printout 45. The novel Web Buckle Sensor 17 is preferably unaffected by the environment with rapid operation, such as a proximity sensor which functions electro-optically whereby the Web Buckle 37 in the process of forming by the Media Feed Roll Unit 67, interrupts a light beam between an emitter and receiver, which may be a fiber optic sensor. This type of sensor is sensitive to the physical size and shape of the Web Buckle 37. This sensor may be of two types. Reflective, and Straight or Flared Through Beam. For example, a flared fiber optic sensor may interact more sensitively to the location of the surface of the Web Buckle 37. Other proximity type sensors may be sonic or ultrasonic that measures a distance between the sensor and the web buckle. Still others may be electro-mechanical limit switches such as a micro switch.

Figure 2:
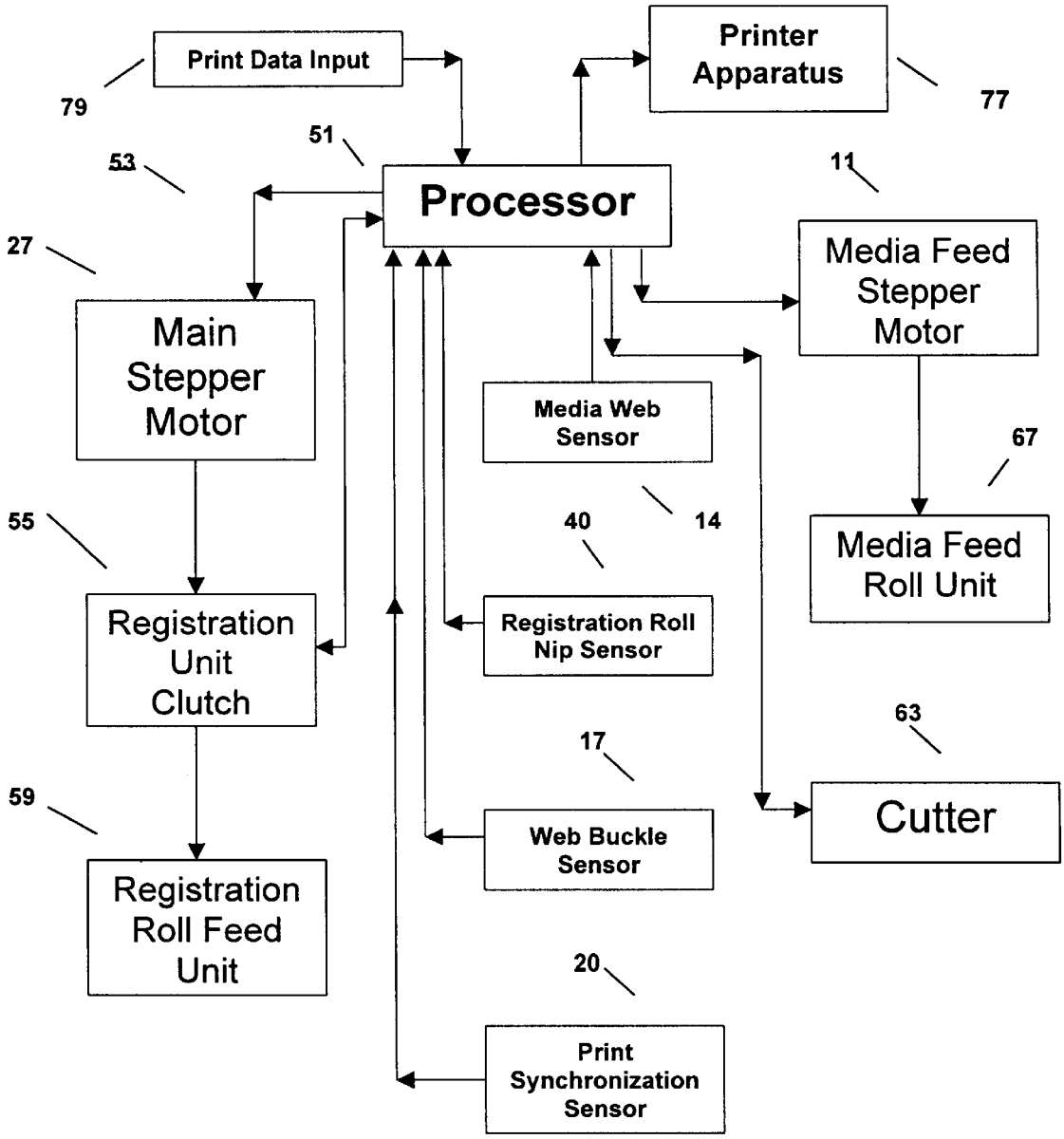
FIG. 2 is a block diagram of the Registration Apparatus Closed Loop Control System.
Figure 3:
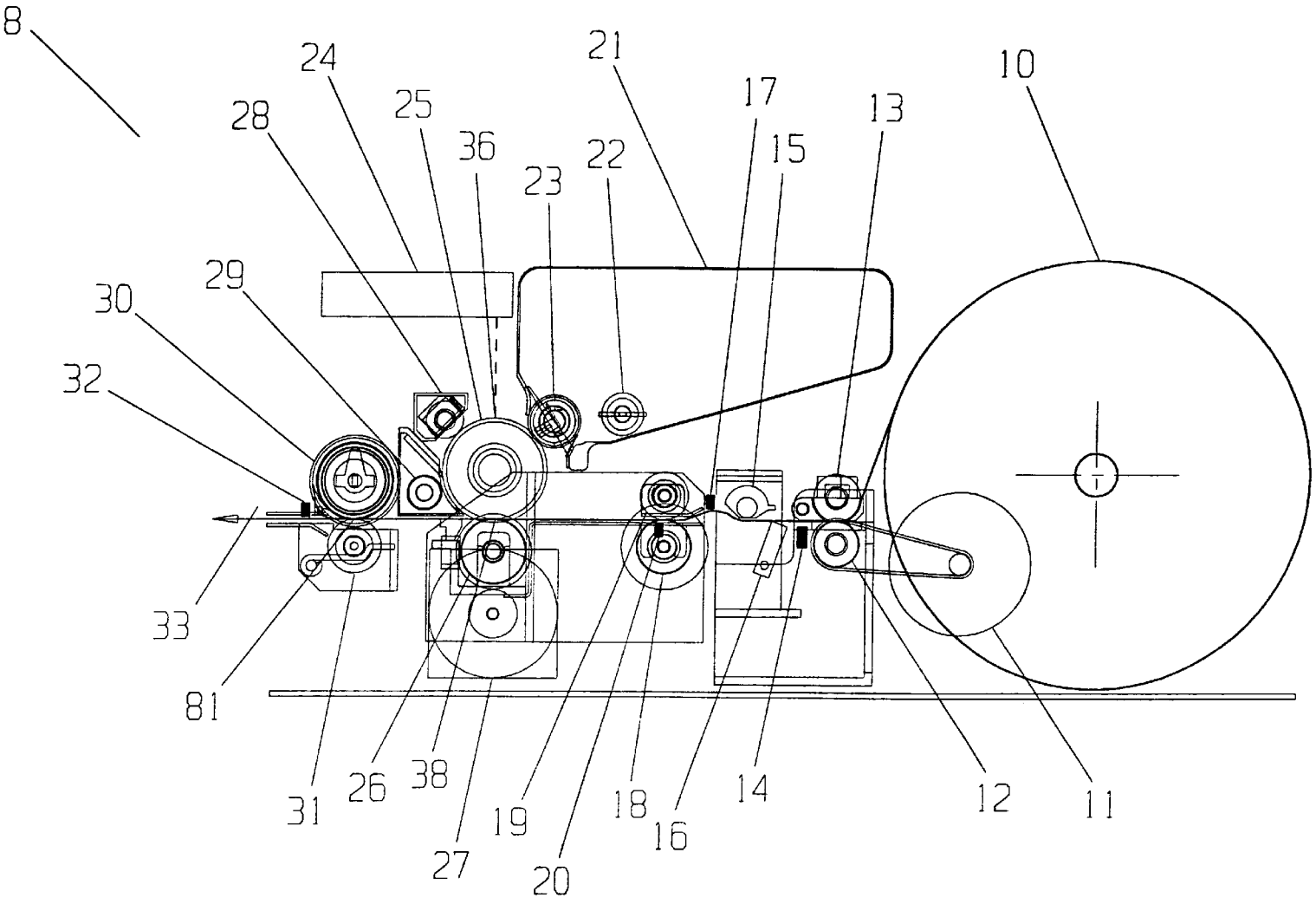
FIG. 3 is a view of the preferred Compact Media Web Electrophotographic (EP) Imaging apparatus incorporating the preferred Registration Apparatus.
Figure 4:
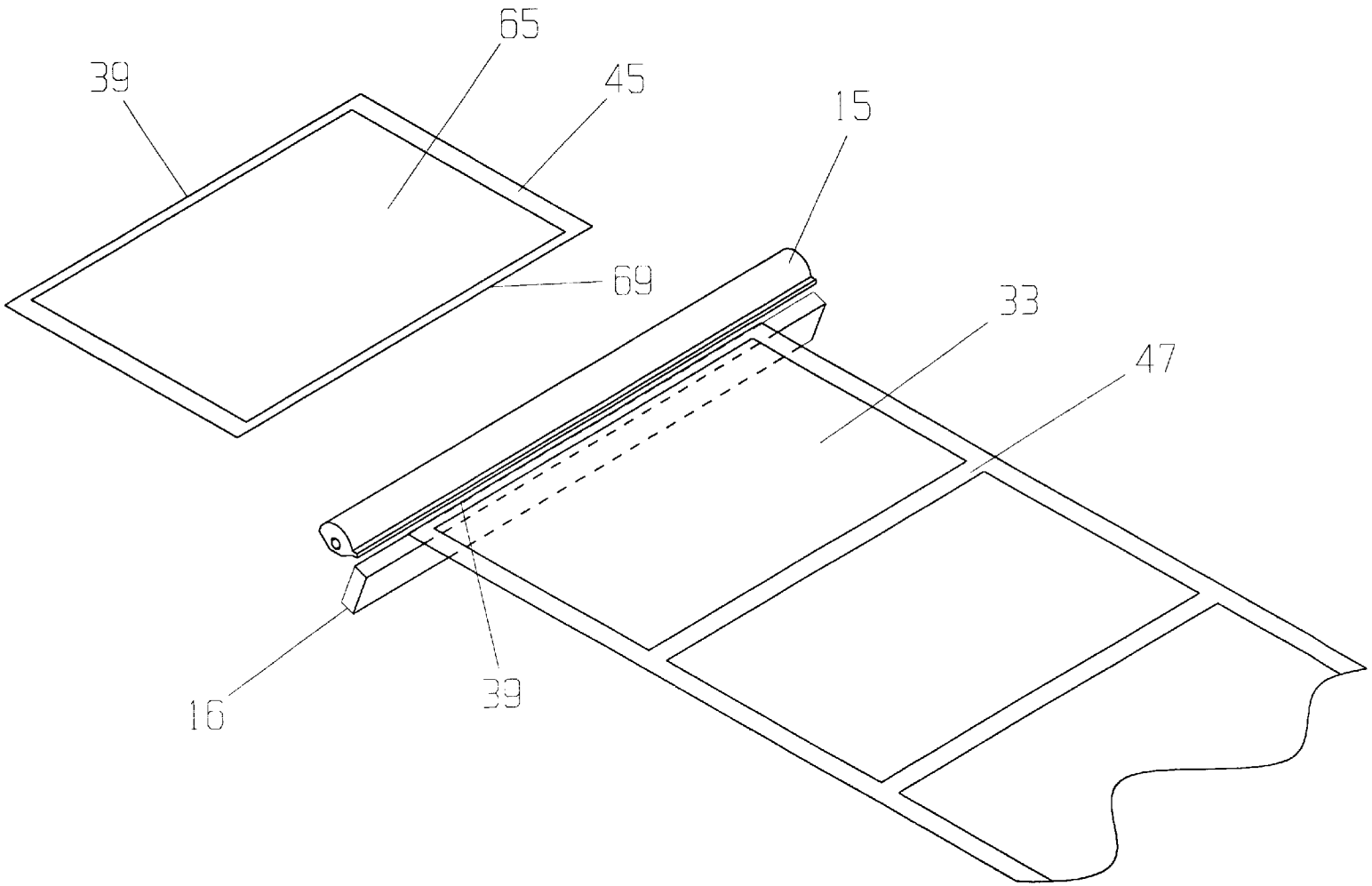
FIG. 4 is a perspective view of the Media Web Cutting Process.
Figure 7:
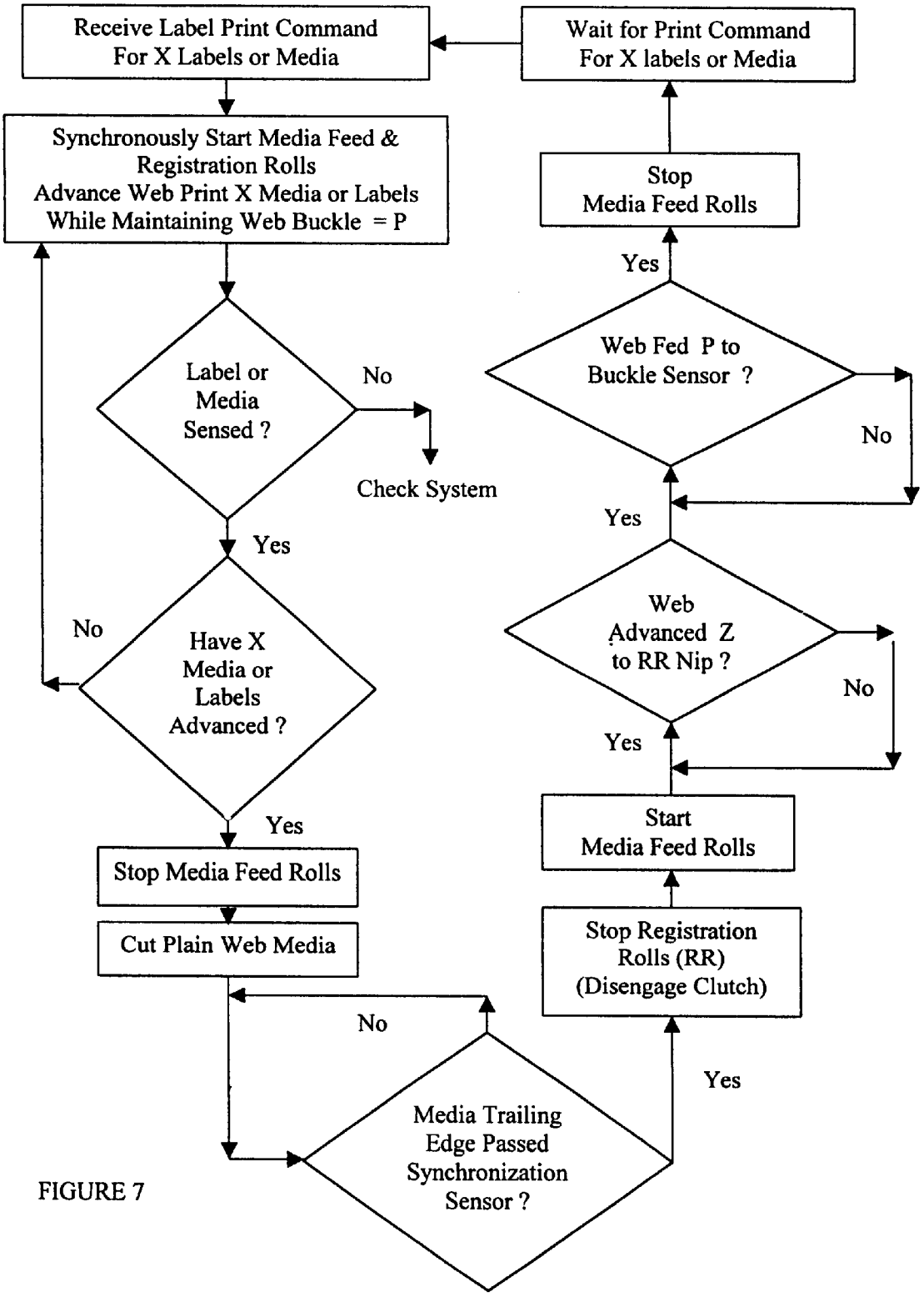
FIG. 7 is a flow chart of the Normal Operating Setup for a Plain Media Web.
Figure 8:
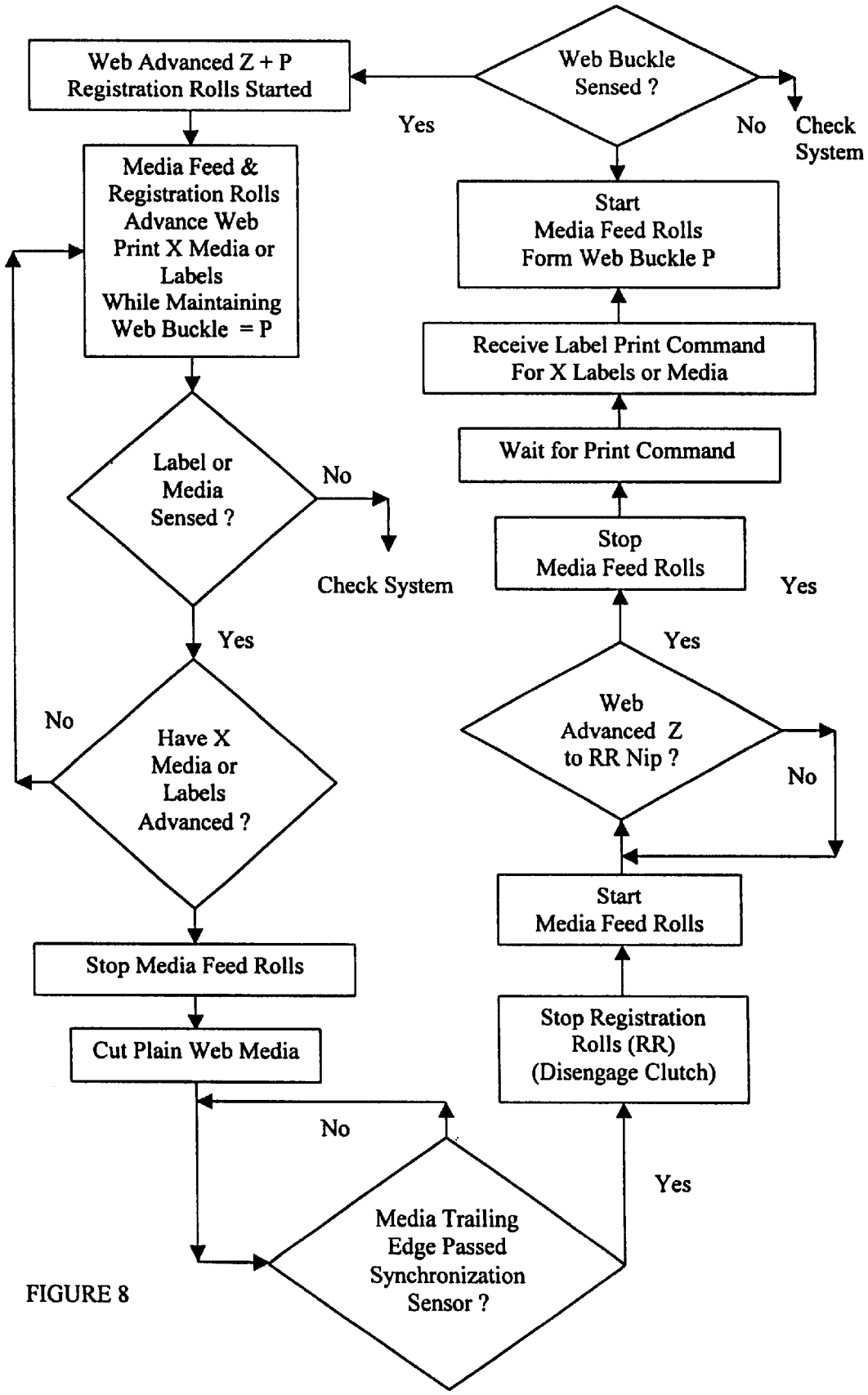
FIG. 8 is a flow chart of the Normal Operating Setup for Media Web with Media Gap or Indicia.

FIG. 2 is a Block Diagram illustrating the new Closed-Loop Control System Circuit 53 for the electrical communication with Processor 51 for the operation of the Printer Apparatus 77 with improved Registration Apparatus 6 and the EP Imaging Apparatus 8, including the sensor system of four key Media Web 33 sensors that synchronize the printing with the Media Web 33 feeding and cutting processes. The key sensors are the Media Feed Sensor 14, the Registration Roll Nip Sensor 40, the Web Buckle Sensor 17, and the Print Synchronization Sensor 20, which continuously monitor the status of the moving Media Web 33, and independently provide feedback to the new Processor 51. A Media Feed Sensor 14, located between the Media Feed Roll Unit 67 and the Cutter 63, signals the Processor 51 that the Media Web 33 is positioned in front of the Media Feed Roll Unit 67, and/or an Indicia or a Media Gap 47 (See FIG. 4) is present. A Web Buckle Sensor 17, located between the Cutter 63 and the Registration Roll Feed Unit 59, provides feedback to the Processor 51 that the Web Buckle 37 is being precisely maintained prior to feeding and cutting. A Print Synchronization Sensor 20, located after but close to the Registration Roll Feed Nip 43, provides dual functional feedback to the Processor 51 after the start of the print job of the Printer Apparatus 77. (1) The cut Media Web Leading Edge 39 is detected to start Imaging 36, as shown in FIG. 3, and (2) the Web Desired Length Trailing Edge 69 is detected by the Synchronization Sensor 20 to stop the Registration Roll Feed Unit 59 and commence the On Line Operating Setup as shown in FIG. 7 or 8. An On Line Operating Setup process shown in FIG. 7 or 8, occurs in every print cycle including the Initial Setup of the Media Roll process shown in FIG. 9, prior to forming the Web Buckle 37, the Media Web Leading Edge 39 must be detected first by the Registration Roll Nip Sensor 40, at a stopped Registration Roll Feed Unit 59. The Processor 51 is in electrical communication with the Printer Apparatus 77 drivers (not shown) of the Media Feed Stepper Motor 11, and the Main Stepper Motor 27. Also, the Processor 51 is preferably in two-way electrical communication with the Printer Apparatus 77 drivers of the operating solenoids (not shown) of the Registration Roll Clutch 55 and the Cutter 63. Where any one of the Printer Apparatus 77 signals including the four key Media Web 33 sensors shown in FIG. 2, provides incorrect Media Web 33 status or fails to provide appropriate feedback relative to the status of the Media Web 33 feed and cut process, the Processor 51 may make digital timing adjustments or shutdown printer operation for evaluation, thereby saving Media Web. The Closed-Loop Control System Circuit 53 achieves simple, and reliable, monitoring and control of unidirectional feeding and printing while further significantly improving productivity with reduced media wastage.

FIG. 3 shows a Compact Media Printer Apparatus 8 with the five image development process steps of Photosensitive Drum 25 cleaning, charging, image writing, developing, transferring, followed by toned image fusing. The improved Registration Apparatus 6 for Media Web, and the like, has a web monitoring and control system for accurate feeding and cutting, including the precise Web Buckle 37 formed at the new Operating Setup after severing of the designated media Desired Length Printout 45. The continuous Media Web 33 of Media Feed Roll 10 may comprise media or other material, adhesive Media Web positioned on a "backer" Media Roll 10, or lineless Media Roll 10. Typically as shown in FIG. 3, during a print job, or a print command for a media or group of Media Web, the Media Feed Stepper Motor 11 drives the Media Feed Roll Unit 67 synchronously with the Registration Roll Feed Unit 59, driven by the Main Stepper Motor 27 registering the Media Web Leading Edge 39, and operating synchronously with the speed of the EP Printing Apparatus 8. Once the novel Operating Setup is completed, the Processor 51 on a print command operates the Main Stepper Motor 27, driving the Registration Roll Clutch 55, and the Media Feed Stepper Motor 11 driving the Media Feed Roll Unit 67, so that the incoming Media Web 33 maintains a consistent Web Buckle 37 ahead of the Registration Roll Feed Unit 59. The Registration Roll Feed Unit 59 functions as the portal to transport the Media Web 33 detected and confirmed by the Registration Roll Nip Sensor 40 as correctly registered into the Printer Apparatus 8 at the start of the print command. The Media Web 33 Printout Leading Edge 39 passes the Print Synchronization Sensor 20, which initiates the LED or Laser Scanner Unit 24 to start scanning the Imaging Writing Line 36 on the Photosensitive Drum 25. When the Processor 51 recognizes the end of print command, the Media Feed Stepper Motor 11 and Media Feed Roll Unit 67 stop, and the Cutter 63 severs the Media Web 33 at the Processor 51 Length Printout 45. The Processor 51 is in two-way communication with the Registration Roll Clutch 55. On a command to print, the Processor 51 signals the Registration Roll Clutch 55 to engage the Registration Roll Feed Unit 59. The Registration Roll Clutch 55 signals the Processor 51 the status of the Registration Roll Clutch 55, whether activated or not. If the Registration. Roll Clutch 55 is activated, then the Media Feed Stepper Motor 11 engages simultaneously. with the Registration Roll Feed Unit 59 to operate synchronously at the same speed to maintain the Web Buckle 37. The Registration Roll Feed Unit 59 and Media Feed Roll Unit 67 control the movement of the Media Web 33, including Desired Length Printout 45 through the Printer Apparatus 77. The Processor 51 also commands the Cutter 63 when to sever the Media Web 33.

It is typical in a Registration apparatus for a Processor 51 to receive information and operate two sets of steppers, Media Feed Stepper Motor 11 and Main Stepper Motor 27, to initiate the various web transport motions described herein, and to synchronize them with the LED or Laser Scanner Unit 24 scanning the Image Writing Line 36 of electronic text or graphic data on the Photosensitive Drum 25, and the toned image transfer to the Desired Length Printout 45 at the Photosensitive Drum/Transfer Roll Nip 73, cutting at Knife Edge 15 and fusing of the toned print image with Toner Fuser Roll 30 which comprises an insulated outer cover for faster warm up and to shield heat from the adjacent Discharging and Cleaning Unit 29 and an inner thin shell surrounding a halogen lamp. The Media Web 33 is advanced as toning takes place between at the Toner Fuser Roll Nip 81 between the Toner Fuser Roll 30 and Pressure Roll 31. Although, the Media Feed Roll Unit 67 and Registration Roll Feed Unit 59 are independent structures, they are controlled by the new Processor 51, which monitors Media Web 33 status and commands the Feed Stepper Motor 11 and the Main Stepper Motor 27, and Registration Roll Clutch 55 engagement to control the Media Web 33 feeding and cutting to assure an accurate Desired Length 45.

However, based on the feedback from the novel four sensor system, the new Processor 51 signals the Media Feed Stepper Motor 11 to operate the Registration Roll Clutch 55 to engage or disengage the Registration Roll Feed Unit 59, and the Main Stepper Motor 27 to drive the Registration Roll Feed Unit 59 primarily to maintain the appropriate Media Web 33 feed to form the precise Web Buckle 37.

As an alternative to on demand thermal printing of Media Web, the improved electro photographic printing apparatus of the present invention utilizes unique methods of setting up and controlling imaging, feeding and cutting, which enhance productivity and minimize media waste.

As previously discussed, the prior art thermal transfer printers come equipped with a variety of media sensors that enable the printer to gauge fixed vertical media length during an off-line the media calibration process that automatically takes place frequently in order to gauge the length of the media material loaded within it and compensate for error build up with the printer shut down.

A variety of sensors previously described may be located within the printer's media compartment—commonly positioned around the thermal print head—detect either or (1) the white spaces (inter-media gaps), and/or (2) black marks on the reverse side of the media stock that represent a media's actual face size (length). (3) And/or notches, slots, or other shaped holes. Printer calibration ensures that the data is aligned and prints correctly on the media stock and is also cut correctly at the center of the media gap after printing. These printer media sensors of the on demand thermal prior art may frequently stop printing to recalibrate off-line, resulting in excessive downtime and wasted Media Web.

In order to utilize standard media material and media design standards to be competitive with the prior art, the Media Feed Sensor 14 may represent single or multiple sensor arrangements (not shown) for the improved electro photographic printing apparatus of the present invention for media web printing and can be configured to contain any one of the below standard sensor varieties:

Plain Media Sensor 14A is used to gauge the presence of plain continuous media. When media or paper is absent, the sensor receives emitted light.

Transmissive Media Sensor 14B is used to gauge media length for media with visible inter media gaps, notches, or pre-punched holes. Light from the sensor passes through the gaps in the media materials semi-transparent backing enabling the printer to measure media length during calibration.

Reflective Media Sensor 14C is a reflective sensor emits light; which is reflected back to the sensor when it reaches a black mark appearing on the reverse side of the media stock. Such specialized media is commonly referred to as black mark media.

Dual Media Sensors 14D are two sensors within the printer (one reflective and one Tranmissive) that have the ability to detect both interlace gap and black mark media, irrespectively.

Multi-functional Sensor 14E refers to a single sensor within the printer that has the ability to detect both interlace gap and black mark media, irrespectively.

The present invention addresses and solves the problem of providing an improved feedback system that monitors the web and synchronizes the media feed, registration and cutter. Furthermore, the present invention more effectively controls the web to increase productivity and further reduce media wastage with improved apparatus and methods.

Figure 9:
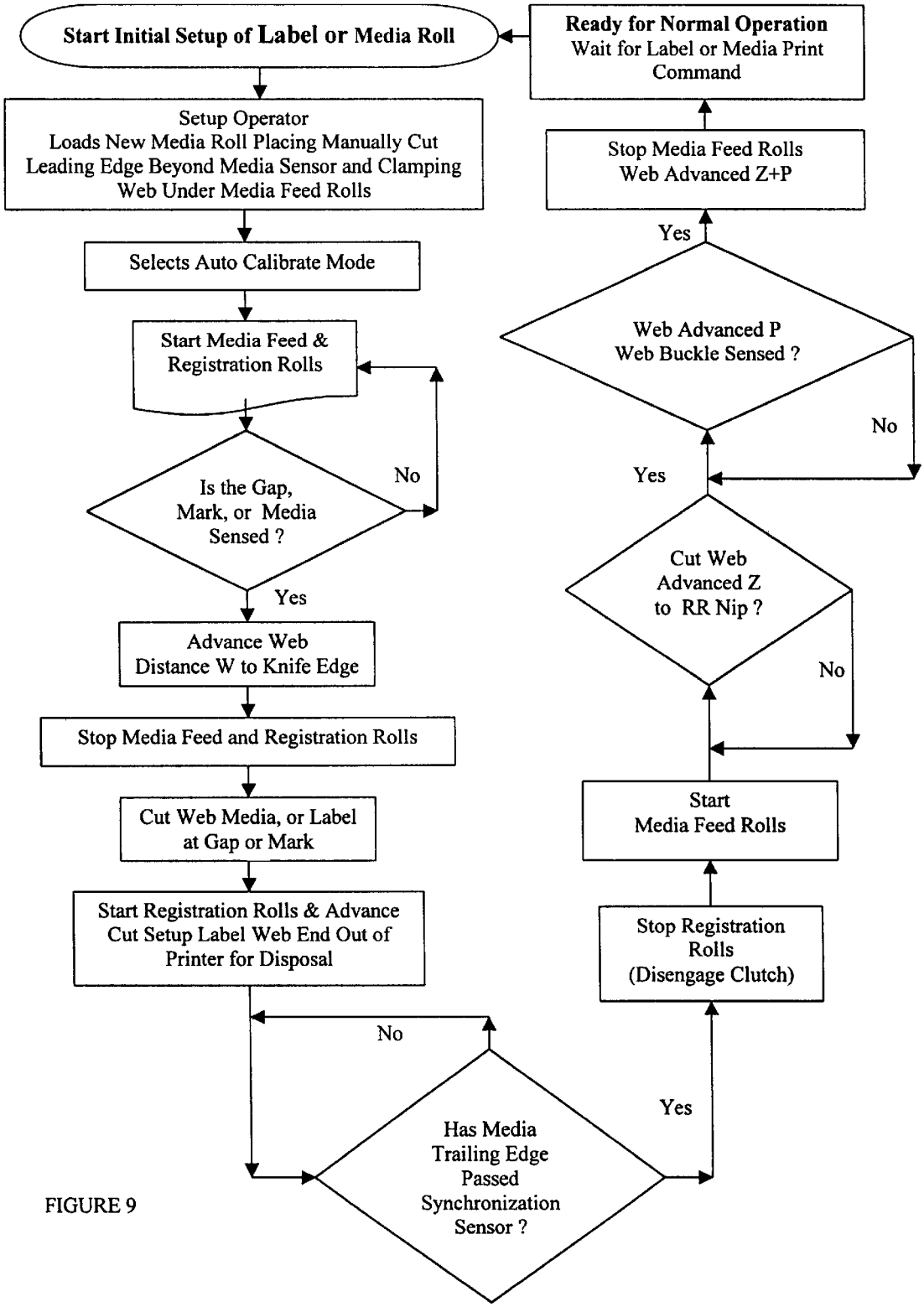
FIG. 9 is a flow chart for the Initial Setup for a Plain Media Web Roll or Media Web Roll with Media Gap or Indicia.

The On Line Operating Setup of Normal Printer Operation, and the Off-Line Automatic Initial Setup of the Media Roll are shown in the flow charts FIGS. 7, 8, and 9 respectively. The Flowcharts illustrate the automatic sequencing and synchronization of the feeding, printing and cutter, with the feedback of the sensors. The Off-Line Initial Setup of the Media Roll is shown in the Flow Chart, FIG. 9, which illustrates the sequencing and synchronization of the feeding, printing and cutter, with the functioning of the sensors during the operator interaction and Automatic Initial Setup of the Media Web Roll 10.

Figure 5:
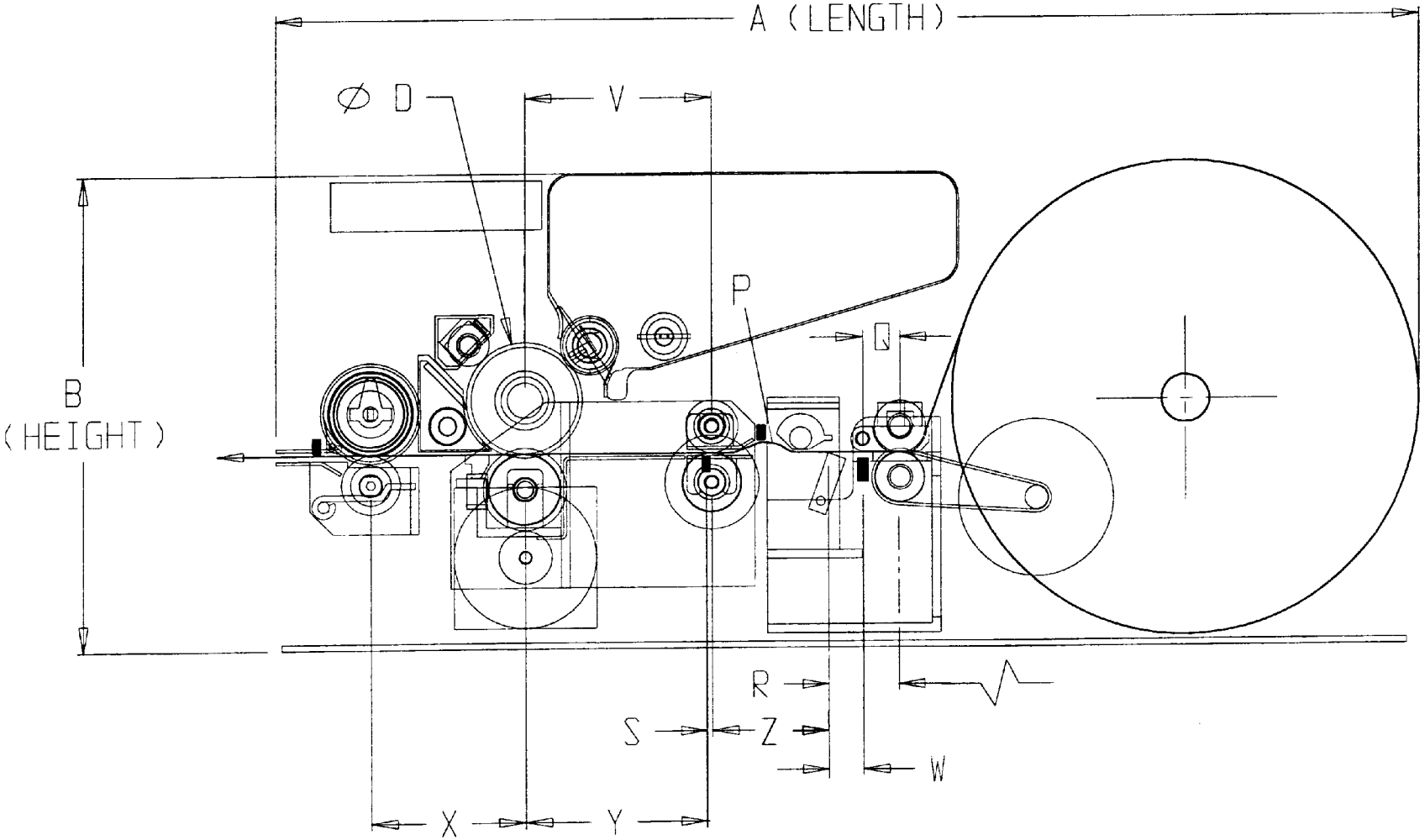
FIGS. 5 and 5A show the key distances between operating units of the Compact EP Printer.

As shown in FIGS. 5 and 9, the automatic Off-Line Initial Setup of the Media Roll is as follows: (Manually load the Media Roll 10 with web cut off manually approximately correct. Place the leading web edge of under the Media Feed Roll Nip 41 of Media Feed Rolls 12 and 13.)

Press Initial Calibrate Button (not shown). The Processor 51 readies the printer for initial web positioning and cut Web Leading Edge 39 setup. The Media Sensor 14 detects a variety of media as described above for either (1) the Media Web Leading Edge 39 in the case of plain Media Web 33, or (2) web 33 comprising Media Web on a backer 71 with indicia, "marked media", or gaps, or holes. The desired length cut location is at the predetermined mid gap line or at the indicia by the knife with Anvil 16.

In the case of plain Media Web, 33, the web leading edge 39 is detected by supplied Plain Media Sensor 14A, whereby the Processor 51 advances the manually cut web edge somewhat beyond the distance W (see FIG. 5) to the Knife 15, stops the Feed Rolls 12 and 13, and cuts the web automatically, whereby the cut web end waste is fed out of the printer.

In the case of Media Web 33 with "marked media" with gaps, holes or indicia, the Processor 51 advances the manually cut web edge beyond the distance W (see FIG. 5) until appropriate sensor(s), one or more Media Sensors 14B thru 14E, whereby a mark, indicia, or gap is detected. Processor 51 then advances the Media Web 33 a distance W, stops the Feed Rolls 12 and 13, and cuts the Web 33 automatically, at the mid gap line or at the indicia with the Knife 15. The cut web end waste is fed out of the printer.

After the Media Web 33 is cut precisely and squarely, the Processor 51 operates the Feed Rolls 12 and 13, feeding the Media Web Cut Leading Edge 39 to the Registration Roll Nip 43, and detected by the Registration Roll. Nip Sensor 40, stop the Media Web 33.

The Printer Apparatus 77 is now ready to start printing using methods according the On Line Operating Setup of Normal Printer Operation, under FIG. 7 or 8, which automatically registers the cleanly cut Web Leading Edge 39 with the start of each on demand print cycle.

Flowcharts of FIGS. 7 and 8, illustrate the On Line Operating Setup processes for Normal Printer Operation. All sensors check the operating status of the Printer Apparatus 77 (FIG. 3) on a continuous basis such that the Media Label 65 is perfect. The improved Registration Apparatus 6 (FIG. 1) is controlled and operated by the Processor 51, whereby each successive print command starts with the completion of the Operating Setup of the Media Web 33. The Operating Setup occurs after each print job when the Print Synchronization Sensor 20, thereby stopping the Registration Roll Feed Unit 59, detects the Web Desired Length Trailing Edge 69. The Operating Setup is included with successive print commands on line, not requiring downtime of the printing process to accomplish any portion of the setup of Media Web for accurate registration with the Printing Apparatus 77. As previously disclosed, each time a Media Label 65 or a group of Media Web is printed and processed, the Processor 51 normally is selected to initialize the On Line Operating Buckle Setup shown in FIG. 7 or the On Line Operating Setup in FIG. 8 for the next print command.

FIG. 7 shows the preferred method for the On-Line Operating Buckle Setup to prepare for a print command, whereby the Web Buckle 37 must be preformed and ready to result in the fastest print cycle. With the Registration Rolls 18 and 19 stopped, the cleanly Cut Leading Edge 39 of the Web 33 is advanced a distance Z by the Media Feed Roll Unit 67 to the Registration Roll Nip 43 detected by the Registration Roll Nip Sernsor 40. The Media Feed Stepper Motor 11 logic counts motor steps to advance a fixed distance Z, as detected by the Registration Roll Nip Sensor 40, shown in FIG. 1. The Web 33 is advanced a distance P to form the Web Buckle 37. When the Web Buckle Sensor 17 is actuated, the Media Feed Roll Unit 67 stops, and the Processor 51 waits for a print command. On a print command both the Media Feed Unit 67 and Registration Roll Feed Unit 59 start simultaneously, and synchronously feed the web at the same speed while maintaining the Buckle Length P of Web Buckle 37.

FIG. 8 shows a preferred method for the On-Line Operating Setup to prepare for a new print command. With the Registration Roll Feed Unit 59 stopped, the cleanly cut Leading Edge 39 of the Media Web 33 is advanced a distance Z by the Media Feed Unit 67 to the Registration Roll Nip 43. Once the Leading Edge 39 is detected at the stopped Registration Roll Nip 43 by the Registration Roll Sensor Nip Sensor 40, the Media Feed Roll Unit 67 is stopped. On the subsequent print command, only the Media Feed Roll Unit 67 starts and advances the Web 33 a predetermined distance P to form the Web Buckle 37. Upon actuation of the Web Buckle Sensor 17, the Registration Roll Feed Unit 59 instantly starts to feed synchronously at the same speed as the Media Feed Roll Unit 67. The method of FIG. 8 is used when there may be a prolonged period of several hours of non-operation, or off line time, when a formed Web Buckle 37 for some media may cause a set in the media buckle, which may result in a media jam.

The Printer Apparatus 77 may be switched from the On Line Setup of Normal Printer Operation method of FIG. 8 to the method of FIG. 7, before the On-Line Operating Buckle Operating Setup is allowed to advance the previously accurately cut Media Web Leading Edge 39 at the stopped Registration Roll Nip 43 to form the Web Buckle 37.

Figure 5A:
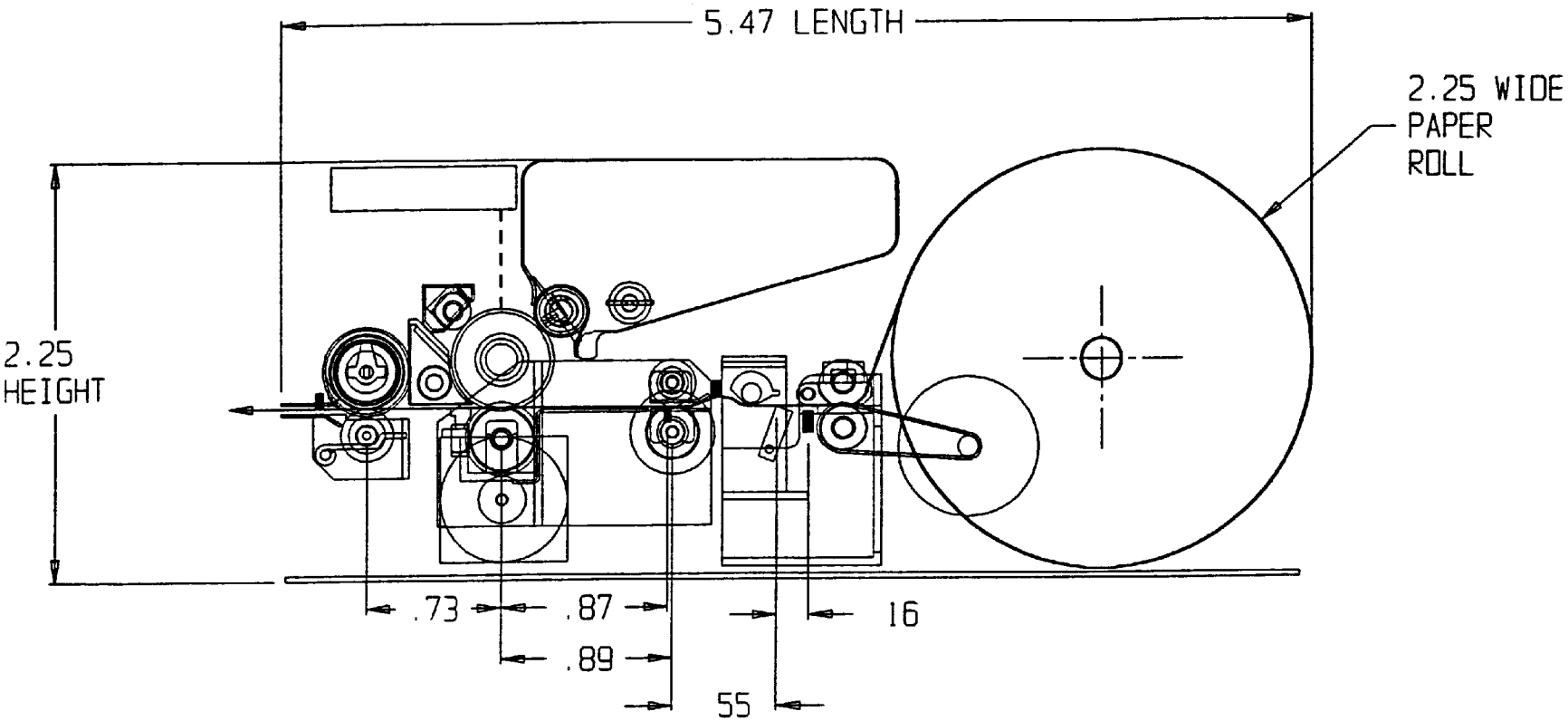

FIG. 5 illustrates in the preferred new Compact Media EP Printer 8, the critical operating units, whereby the distance between their operating roller nips must be minimized to provide the shortest allowable Desired Length Printout 45. The fixed distances X, V, Y, S, Z, W and Q between related critical operating unit nips, components and sensors must be minimized for compactness and to enable Processor 51 to print the shortest Printout 45. Media Web, which may be under one inch long as shown in FIG. 5A. X is the distance between the Toner Fuser Roll Nip 81 and Registration Roll Nip 43, (Shown in FIG. 3). V is the distance between the Registration Roll Nip 43 and the Photosensitive Drum/Transfer Roll Nip 73. Y is the distance between the Synchronization Sensor 20 and the Photosensitive Drum/Transfer Roll Nip 73. S is the distance between the Registration Roll Nip 43 and the Print Synchronization Sensor 40. Z is the distance between the Registration Roll Nip 43, or the Registration Roll Nip Sensor 40, and the Knife Edge 15 where the Buckle Length P is an additional web length to form the Web Buckle 37. W is the distance between the Knife Edge 15 of Cutter 63 and the Media Feed Sensor 14. Q is the distance between the Media Feed Sensor 14 and the 41 Media Feed Roll Nip.

The cutter 63 response time should be as short as possible to keep the Web Buckle 37 length P at a minimum. The distance Z must be long enough to form an adequate size web buckle 37 to allow enough time for the Knife Edge 15 to sever the Web 33 for creating the minimum Desired Length Printout 45. The distance Z should be as short as possible and the overall sum of Z minus W should be smaller than V to allow the indicia or media gap 47 to be read by Media Sensor 14 for the first Media Label 65. The distance Q should be as short as possible to keep the length of printer short. With the sensor system 40, 14, 17, and 20 for monitoring the Media Web 33, the new Processor 51 constantly controls the "correct" longitudinal positioning and printing of the advancing Media Label 65, including the Web Leading Edge 39, the Web Desired Length Trailing Edge 69, and the "correct" Web Buckle 37 size for conformity.

The Media Feed Sensor 14 is located just after the Media Feed Roll Nip 41. The Web Buckle Sensor 17 is located just before the Registration Web Guide 42 located before the Registration Roll Feed Unit 59, and after the Cutter 63. The Synchronization Sensor 20 is located just after the Registration Roll Nip 43. The fixed distance Z minus S from the Registration Roll Nip 43 to the severing point, or Knife Edge 15, of the Cutter 63, must be long enough to form an adequate size Web Buckle 37. The web Buckle Length P must be large enough for the severing to take place before the Web Buckle 37 flattens out during the feeding of the Web 33 by the Registration Roll Feed Unit 59. The distance W from the Knife Edge 15 of the Cutter 63 to the Media Feed Sensor 14 must be long enough to provide adequate lead-time needed to respond to a cut command from the Processor 51 upon detection of the Media Gap 47, or indicia, by the Media Feed Sensor 14. When the Media Gap 47 reaches the Media Feed Sensor 14 during web feeding, the Processor 51 based on Print Data Input 79 makes the decision to continue or stop the Media Feed Stepper Motor 11 when the Media Gap 47 has traveled the Distance W to the Knife Edge 15. The Distance V between the Photosensitive Drum/Transfer Roll Nip 73 and the Registration Roll Nip 43, generally dictates the shortest Media Desired Length Printout 45 that can be mechanically processed by the Registration Roll Feed Unit 59. The Processor 51 stores that known portion of the minimum media cut length Z+W+P in terms of motor steps, or other digital clock means responsive to the sensor system or arrangement used to time a distance interval, for example from the sensing of the Web Leading Edge 39. The minimum media cut length Z+W+P is designed to be equal to or less than the Distance V, the minimum Desired Length Printout 45 [feed length]. With this relationship established, the Media Gap 47 following the fixed Operating Setup (Z+P) of the Media Web Leading Edge 39 and Web Buckle 37 at the Registration Roll Nip 43 will be detected by Media Feed Sensor 14 on the execution of the next print command sequence. The Media Gap 47 is at a Distance R from the Knife Edge 15 of the Cutter 63, whereby L, the Desired Length Printout 45, equals (Z+P)+R, which must be greater then Distance V.

In addition, the distance S+Z+P must be long enough to be capable of cutting the shortest Media Label 65 equal to or greater than V. The distance Y is determined by and is equal to the design length of the Portion of the Circumference T, equal to the Photosensitive Drum 25 diameter D from the Image Writing Line 36 on Photosensitive Drum 25 (see FIG. 3) to the line of toned Image Line 36 printing on the Desired Length Printout 45 at the Photosensitive Drum/Transfer Roll Nip 73. The start of laser beam latent imaging on the Photosensitive Drum 25 at Image Writing Line 36 continues on rotation of the Photosensitive Drum 25 to the Photosensitive Drum/Transfer Roll Nip 73, where the Media Web Leading Edge 39 must meet the start of the desired transferred toned image including the margins. This distance T traveled on the from the first Image Writing Line 36 to on the Photosensitive Drum 25 of diameter D dictates the required distance Y between the Photosensitive Drum/Transfer Roll Nip 73 and the Print Synchronization Sensor 20. As shown in FIG. 5A, Y=0.87 inch. With T=Y, D=0.55 inch.

Furthermore, the minimum leading margin of the Desired Length Printout 45 is dictated by the distance S between the Print Synchronization Sensor 20 and the Registration Roll Nip 43, which should be made small to avoid media wastage when determining the maximum theoretical length of the print image portion of the Desired Length 45 that can be processed. In the printing process to assure that the printed image portion of the Desired Length Printout 45 is correct. The Processor 51 in FIG. 2 receives the print information from a Print Data Input 79 and translates it to desired print format and controller output; compares the result with the synchronization input and feedback from the sensor system 40, 14, 17, and 20, stores in memory any operating changes required to accurately process the defined Desired Length 45. The Processor 51 establishes the Desired Length Printout 45 and the correct motor steps to advance the Media Web 33 to assure the Desired Length 45 with no error or wastage. The sensors provide the actual Media Web 33 and Media Label 65 positioning feedback data to the Processor 51. The feedback data during the Web 33 feeding and cutting, from the timing of the four key Desired Length Printout 45 sensors, the actuation of the Web Buckle Sensor 17, the Print Synchronization Sensor 20, or the Media Gap 47 or Indicia Cut Position at Knife Edge 15, indicated by the Media Feed Sensor 14. The Processor receives feedback from Media Web Leading Edge 39 at the Registration Roll Nip Sensor 40.

The sensors may indicate that the Media Web 33 needs to be advanced more or less to maintain the Desired Length 45, under the circumstances such that when the Print Synchronization Sensor 20 provides feedback to the Processor 51 that the Media Web Desired Length Trailing Edge 69 (See FIG. 4) has passed the Registration Roll Feed Unit 59, or the Operating Setup for the next Web Buckle 37 is allowed to commence while printing is finishing. The Processor 51 coordinates each On Line Operating Setup with the Web Buckle Sensor 17 confirming the formed Web Buckle 37 whereby the Processor 51 with digital means for adjusting the time interval, increases or decreases Media Feed Motor 11 steps to set a Buckle Length P, while placing the accurate Media Web Leading Edge 39 at the stopped Registration Roll Nip 43 at the Distance (Z+P) from the Knife 15. The Desired Length 45 equals (Z+P) plus a Distance R that can vary depending on the total Length, L. The Processor 51 commands the Cutter 63 when to sever the Media Web 33 based on the Distance R beyond the fixed length (Z+P) resulting in the Desired Length Printout 45, L=(Z+P)+R. The Processor 51 must assure that the printed portion remains undisturbed and correct and within the Desired Length Printout 45 with Leading Edges 39 and Trailing Edges 69. Therefore, compensation for small deviations in the feeding, cutting and printing process must be remedied by varying the leading and trailing margins.

Figure 6:
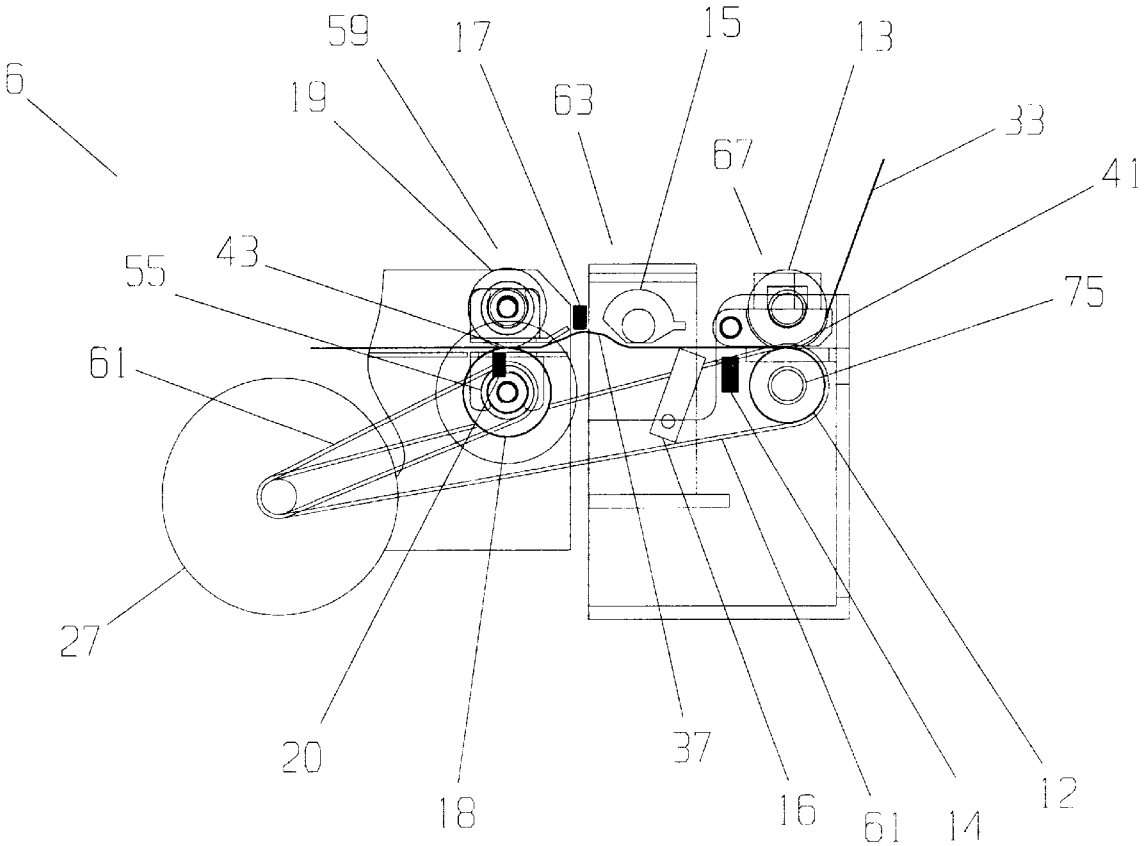
FIG. 6 is a view of the alternative Registration embodiment having a single drive motor.
Figure 10:
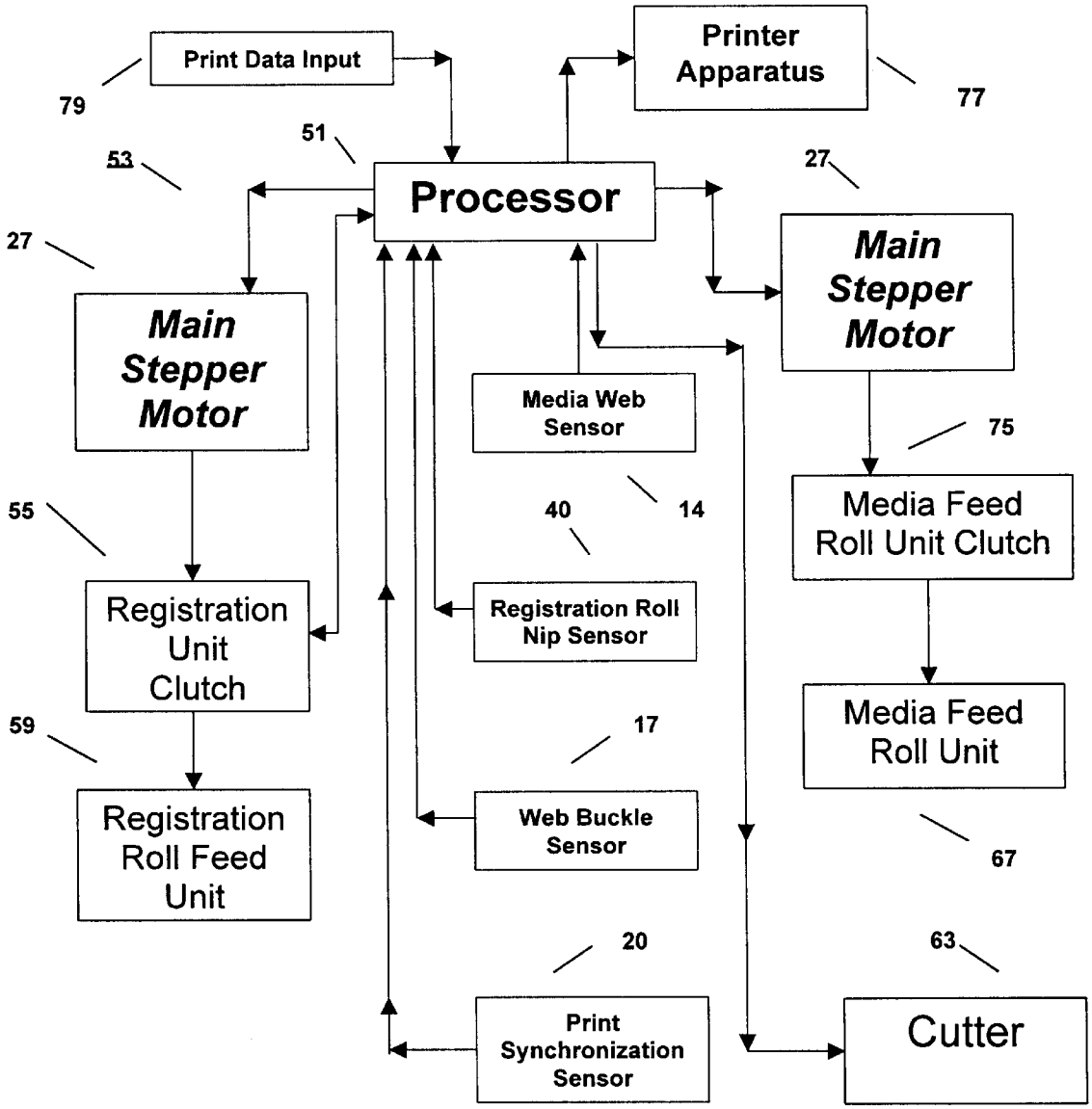
FIG. 10 is a block diagram of the Closed Loop Control System of an alternative Registration embodiment.

An alternative Registration Apparatus 6 shown in FIG. 1 is shown in FIG. 6, with Closed-Loop Control System Circuit 53 shown in FIG. 10, with the difference where the Media Feed Roll Unit 67 may be operated by the Main Stepper Motor 27 through a Media Feed Roll Clutch 75, as the second web feed drive in place of a separate Media Feed Stepper Motor 11, at substantially the same drive speed as the Registration Roll Feed Unit 59. In effect, the Processor 51 controls on LED or Laser Scanner Unit 24 as a system clock with LED or laser Image Writing Line 36 writing on the Photosensitive Drum 25 and synchronized with the printer apparatus Main Stepper Motor 27 forward stepping or advancing of the Media Web 33, and simultaneously controlling the Media Feed Roll Unit 67 and Registration Roll Feed Unit 59 driving the Media Web 33 in all modes of operation including initial setup, operating setup, and the printing operation. The Media Feed Roll Unit 67 and Registration Roll Feed Unit 59 operate at the same time at constant speed to move the web, except on Web Buckle 37 setup at each completed Printout with only the Registration Roll Feed Unit 59 stopped, and when cutting the Media Web 33 with the Media Feed Roll Unit 67 stopped as previously described in FIG. 1

Figure 11:
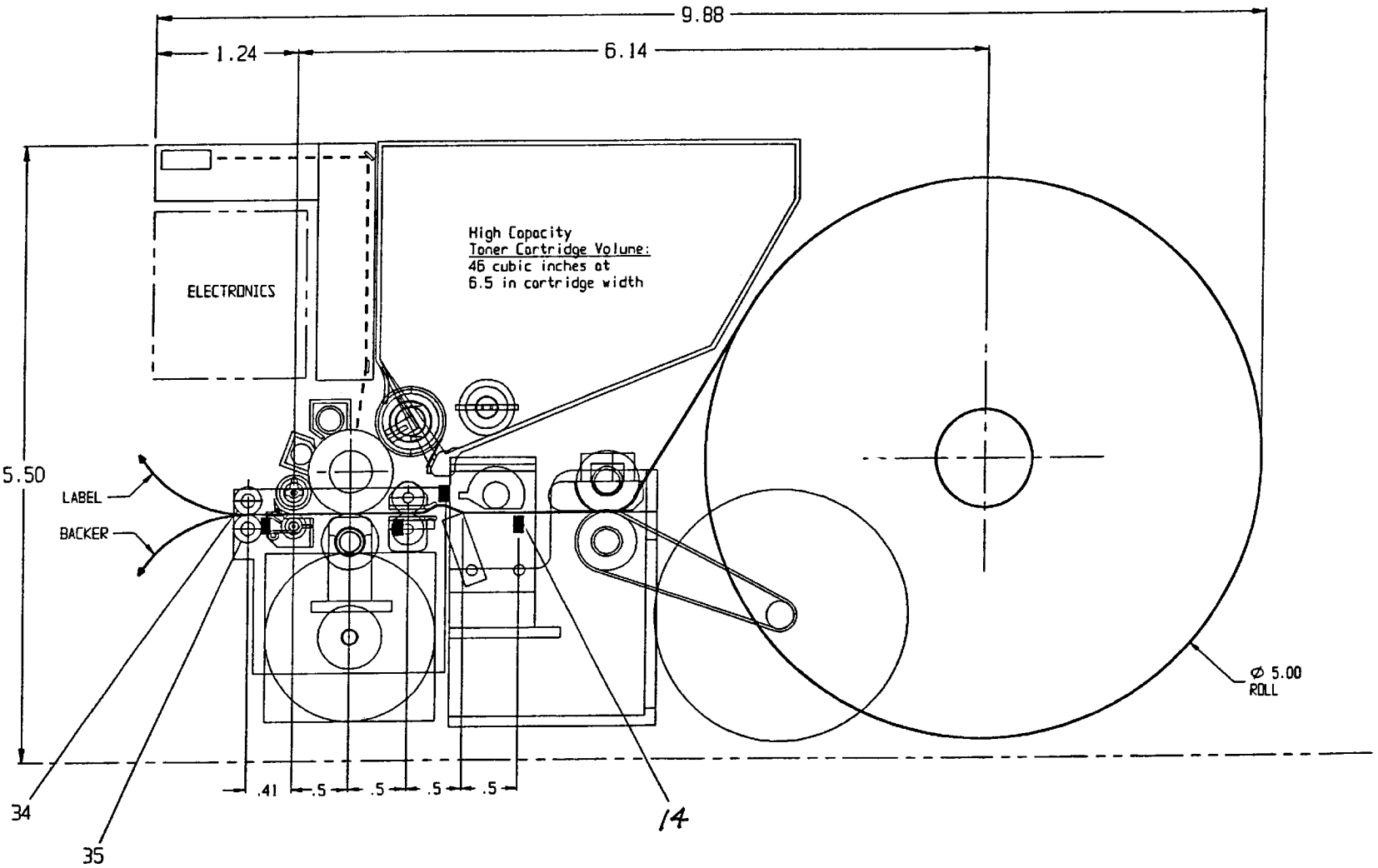
FIG. 11 is an explanatory diagram of a second preferred embodiment of an On Demand Media Web Electrophotographic Printer with a high capacity cartridge and including a media with an adhesive label vacuum-peeling unit.

FIG. 11 shows a High Capacity Cartridge EP Media Printer with the capability to handle a short Desired Length Printout 45, includes a Media Vacuum Peeling Roll 34 for peeling the an adhesive,back Media Label 65 from the Backer 71 and a Backer Vacuum Peeling Roll 35 for peeling the Backer 71 from the Media Label 65, whereby the advancing media sequentially opens vacuum as the Rolls 35 and 36 rotate to cause a separation of the Media Label 65 from the Backer 71 of the Desired Length Printout 45. The operation and subassemblies of FIG. 11 have the same or equivalent functional components as FIGS. 1, 2, and 3 except that a method such as ejection rolls 34 and 35 may also be utilized to eject the Media Label 65 from the printer. Media Web 33 print width, similar to print speed, differs from one media printer to another. Most printer models are designed to print 4" wide Media Web. Still others print 2", 3", 5", or 6.6" wide Media Web. The widest print width is about 8.0". Depending on the application and the required media width becomes yet another Media Web selection criteria.

Figure 12:
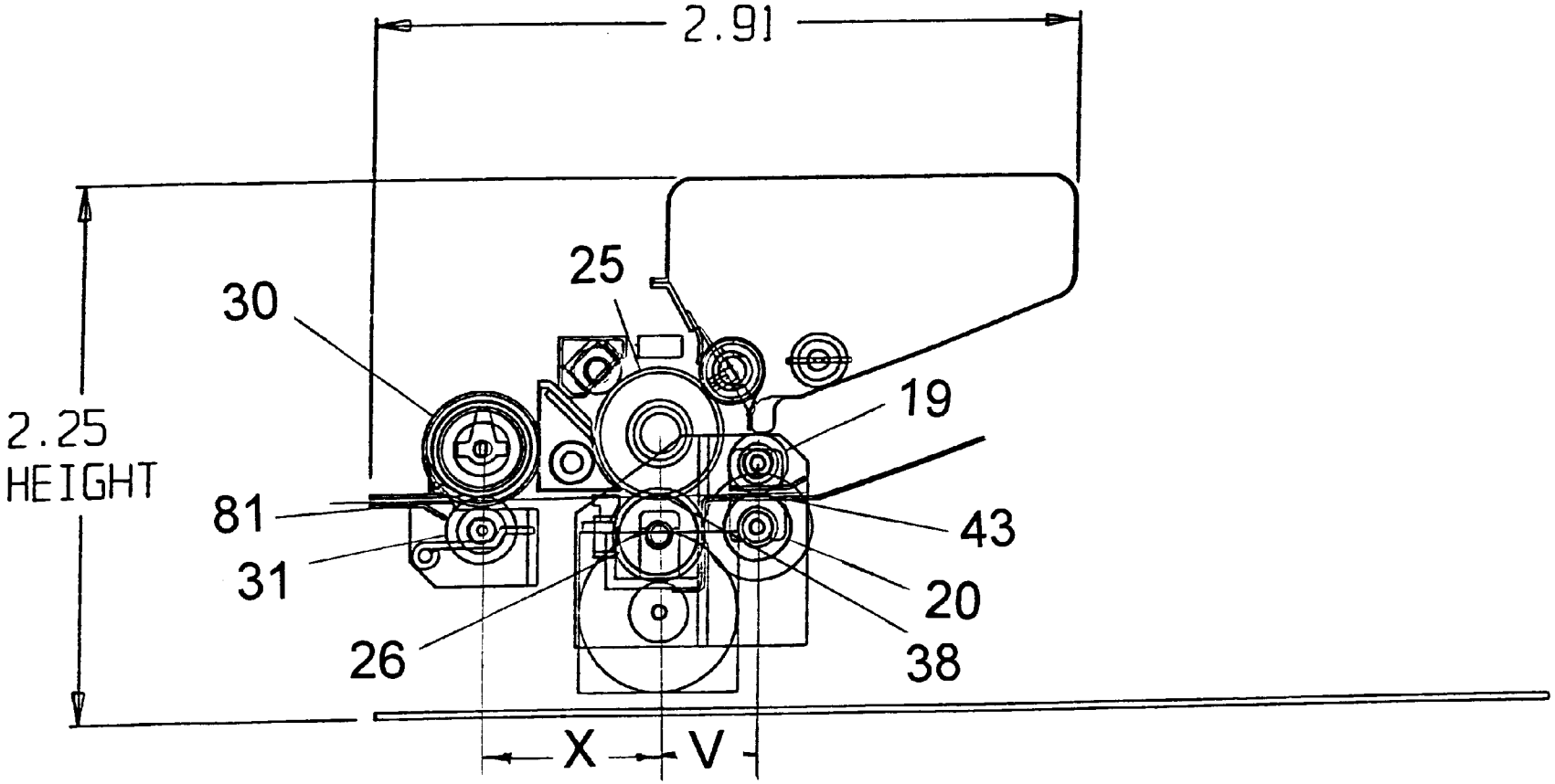
FIGS. 12 and 12A shows an explanatory diagram of a preferred embodiment of a compact, portable on demand electrophotographic sheet or card stock printer.
Figure 12A:
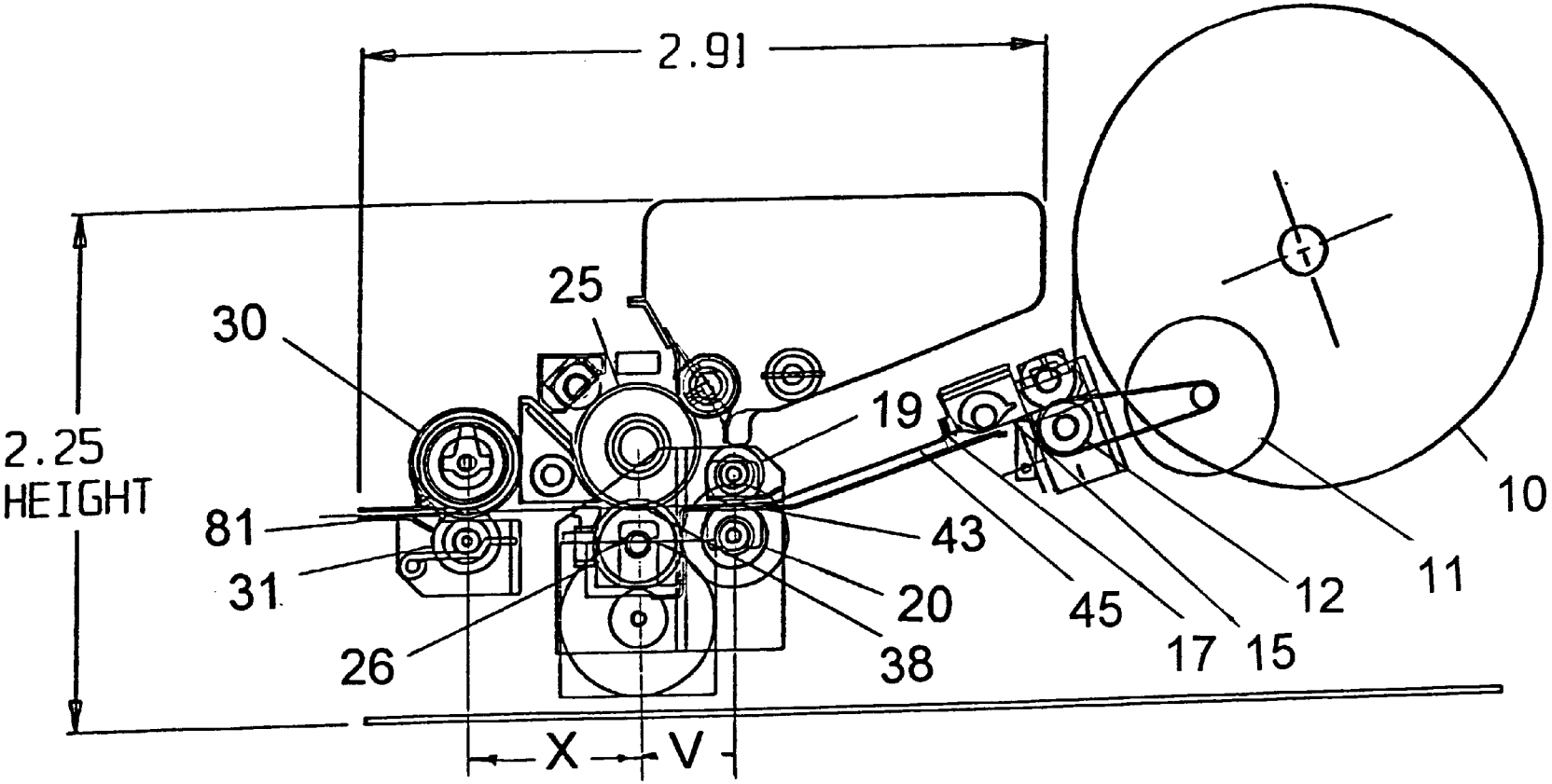

FIG. 12 shows a new on demand compact printer with closely spaced operating units exactly the same as shown in FIGS. 3, 5, and 5A for short printout(s) 45, registering flat printouts 45 with a small deflection or minimum buckle sensor 17, except that the compact industrial marking printer of FIG. 12 comprises a printer modification with only closely spaced Registration Roll Nip 43, Photosensitive/Transfer Roll Nip 38, and Pressure Roll Nip 81 for transporting and processing short, flat printout(s) 45. The modular printout 45 width may vary from 1 to 8.5 inches to accept short, flat media, and card stock, such as fanfold labels, airline tickets, checks, photos, ID cards, credit cards, RFID Tags and smart cards, wherein the short, flat printouts 45 typically range from less than 1 to about 4 inches long. FIG. 12A shows the apparatus of FIG. 12 further including a web feed and cut mechanism 6 for registering flat printouts 45 from a roll with a small deflection or minimum buckle sensor 17, wherein the distance between the knife edge 15 and the registration roll nip 43 accommodates he desired or shortest allowable flat printout 45.

Figure 13:
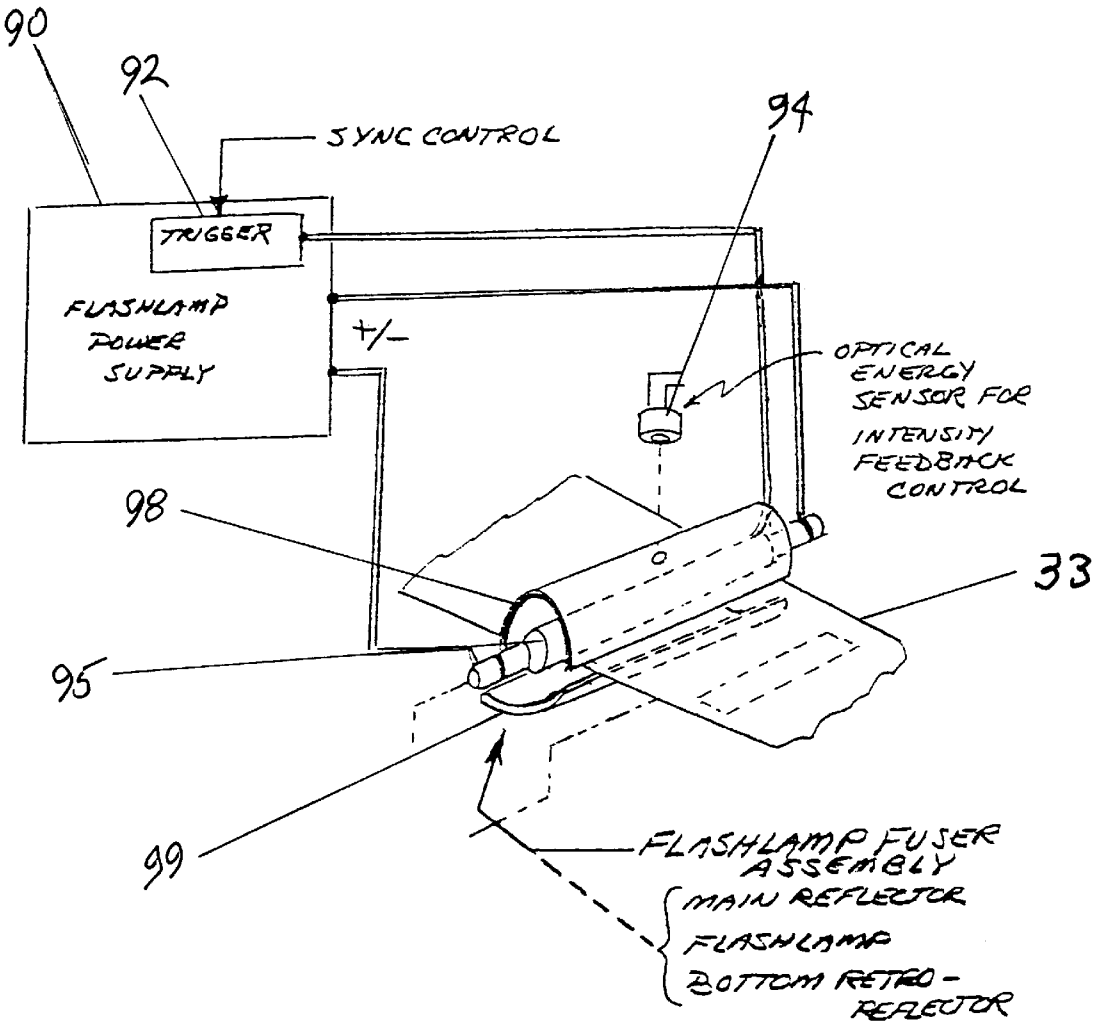
FIG. 13 is an explanatory diagram of a preferred embodiment of a non-media contact, flash fuser for a narrow format Media Web Electrophotographic Printing Apparatus.

FIG. 13 shows a Compact, Low Cost, High Speed Media Web Flash Fuser for a Narrow Web, which fuses the toner image without contact or heating the media adhesives, or lineless web adhesive, or any other printing application. The flash lamp 95 shown in FIG. 13 is a xenon gas filled type, but may instead be filled with another suitable gas (or gas mixture) such as krypton or argon. The xenon lamp 95 may also have other elements within or external, which will enhance the spectrum, specifically to match the absorption spectrum of the toner or other photo initiator. The fill pressure of the gas will be optimized to match the absorption spectrum of the toner or other photo initiator. The voltage and capacitance of the discharge energy will be optimized for maximum efficacy and to match the absorption spectrum of the toner or other photo initiator.

The toner or photo initiator will be spectroscopic to be analyzed from UV (180 nm) out to IR (5 microns) to determine the emissive function and Stefan-Boltzman integral. The intent, is consistent with the explicit advantage of knowing how to control the flash lamp 95 emission spectra by manufacture and operation. The positioning of the core of the flash lamp 95 plasma will be controlled with the intent and advantage of the precise focusing of the emitted radiation, as well as repeatability of uniformity.

An optical energy sensor 94 with a spectrally selective optical filter for intensity feedback control. With suitable hysteresis, the flash lamp 95 effectiveness can be maintained constant automatically by adjusting the power supply 90 discharge voltage. An error function will monitor lamp lifetime information and replacement. The flash lamp 95 pulse (rate and energy) may be programmed or controlled by other similar sensors, which are adapted to the type of toner or photo initiator, or the target material, or the speed of the conveyor. Probably the most important advantage of employing the flash lamp 95 for fusing applications is the indisputable empirical evidence that PULSED energy is far more effective in penetrating the toner or photo initiator for curing, as opposed to CW sources, which tends to "surface" cure.

For the energy levels proposed, the plasma is essentially transparent to the reflected radiation. The reflectors 98 and 99 may be formed from special, highly reflective, and environmentally conditioned sheet metal; or, may be machined from solid metal (and reflectively coated). They may be replicated with a glass material, and coated with a diachronic coating, which would allow the transmission of unusable heat radiation while reflecting the cure-effective spectrum of the emitted radiation. The shape of the reflectors 98 and 99 will reflect the maximum amount of emitted radiation toward the target. They may be cylindrically ellipsoidal, parabolic, spherical, toroidal, or some combination.

Toner Fuiser Pulised Flash Lamp: A xenon gas filled Lamp 95 have elements within or external, which will enhance the spectrum, specifically to match the absorption spectrum of the Toner or other photo initiator. Flash Lamp 95 is optimized for maximum efficiency and to match the absorption spectrum of the toner or other photo initiator.

Control of the Flash Lamp Emission Spectra: The positioning of the core of the flash lamp 95 plasma will be controlled with the intent and advantage of the precise focusing of the emitted radiation. An optical energy sensor 94 with a spectrally selective optical filter will be employed for intensity feedback control.

Flash Lamp Pulse (Rate and Energy: Pulsed energy is far more effective in penetrating the Toner or photo initiator for curing. It is adapted to the type of toner or photo initiator, or the target material, or the speed of the printer conveyor.

Reflector Material: Reflectors 98 and 99 may be formed from special, highly reflective, and environmentally conditioned sheet metal; or the Reflectors may be replicated with a glass material, and coated with a diachronic coating, reflecting the cur-effective spectrum of the emitted radiation.

Reflector Shape: The shape of the Reflectors 98 and 99 are devised to collect and reflect the maximum amount of emitted radiation toward the target. The bottom retro reflector 99 collects that radiation which has already passed through the target from the top reflector 98, and redirects it back to the target area or the Media Label 65 on the Media Web 33 for added effectiveness. All of the emitted energy is confined between the top and bottom reflectors 98 and 99 respectively. The radiation will be forced to traverse repeatedly through the target area until finally expired through absorption.

Figure 14:
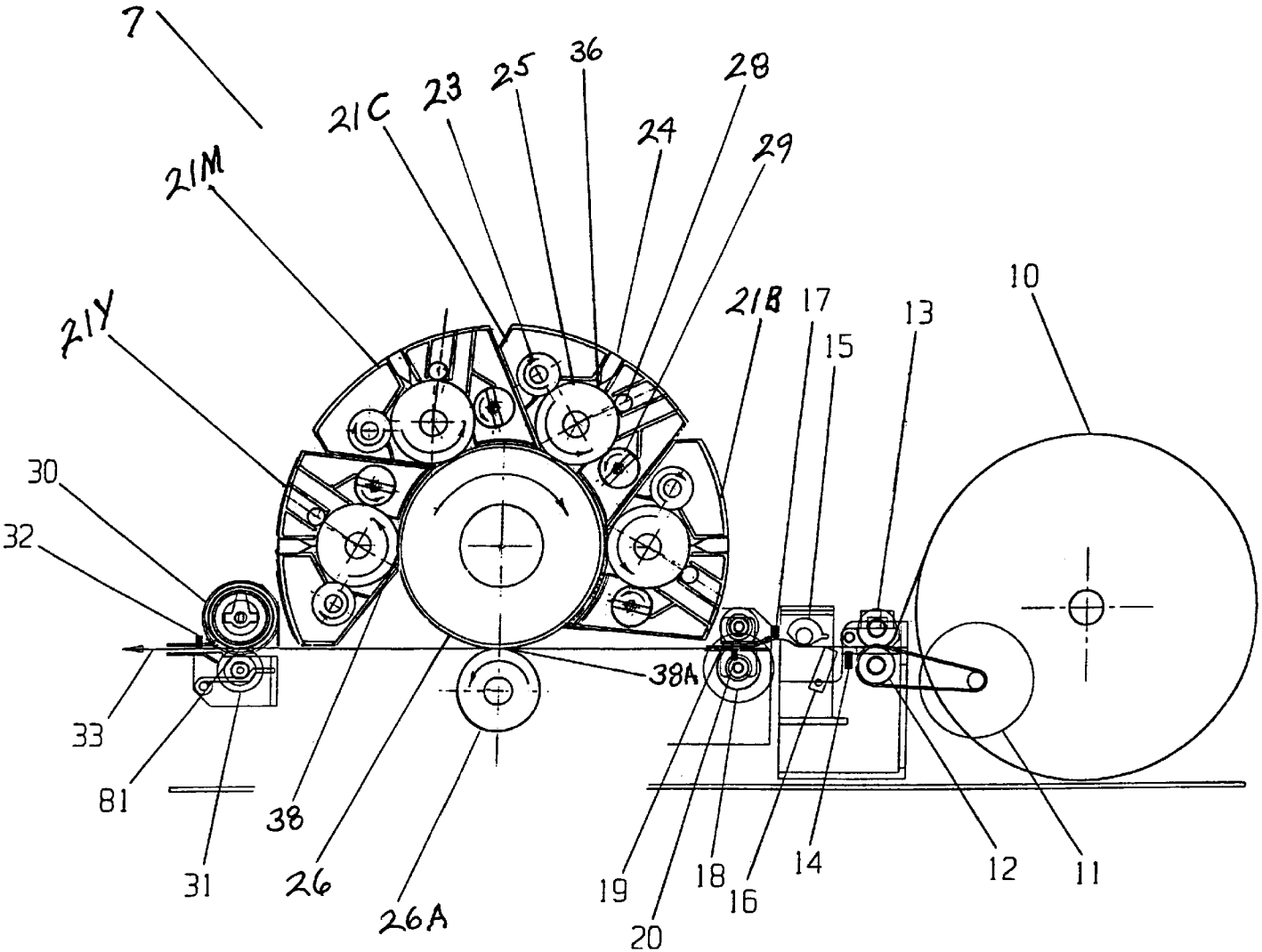
FIG. 14 is an explanatory diagram of a first preferred embodiment of an On Demand Serial Full Color Media Web Electrophotographic Printing Apparatus.

FIG. 14 shows a novel Compact Full Color Printer Apparatus 77. This unique Compact Electrophotographic (EP) Full Color Imaging Apparatus 7 may include the Registration Apparatus 6 shown in FIG. 1, for feeding and cutting the Media Web. The EP Imaging Apparatus 7 comprises simple, compact mechanical precision alignment of closely spaced serial, plural color cartridges 21, which may comprise six colors for high quality conventional photographs. Shown are four preferred colors for full color printing, namely cartridges Yellow 21Y, Magenta 21M, Cyan 21C, and Black 21B respectively. The cartridges 21 are arranged radially and parallel to each other around a common Transfer Roll 26, each with a Photosensitive Drum/Transfer Roll Nip 38. These uniformly offset cartridges 21 are commanded to print with simple desired time delay electronic control from Processor 51 to cause the four-color images to have precisely aligned toned images registration on the common Transfer Roll 26. The four colors, as previously described, are laid down on the common Transfer Roll 26 and subsequently on the recording medium or Media Web 33 by Recording Transfer Roll 26A at Recording Transfer Roll Nip 38A in a serial or sequential fashion in a non-repeating process during a single pass relative to the cartridges Yellow 21Y, Magenta 21M, Cyan 21C, and Black 21B. Although, the Registration Apparatus 6 shown in FIG. 1 is disclosed in FIG. 14, any media handling method may be used for other media or recording medium; such as cut sheet, fan-fold, smart cards, or the like. On completion of image transfer as shown in FIG. 14, the full color toned image is fused or bonded on the Media Web 33 as completion of the printing process. The Flash Fuser Unit 91 shown in FIG. 13 may be used for high speed, non-contact, or the Pressure Roll Fuser Unit 85 of FIG. 3 may be used for less expensive fusing for narrow or standard format printing. The basic EP imaging process may be substantially used for each color as shown in FIG. 3. The compact, low cost, four color EP Imaging Apparatus 7 removable color cartridges 21 print with a time delay between them for continuous image forming. Precise registration with simple, low cost mechanical offsets between the color cartridges 21 of the Imaging Apparatus 7 with the removable color cartridges 21 closely spaced and parallel side-by-side, with a straight, horizontal single pass printing, the four color modules are synchronized with unidirectional feeding of the Media Web 33. A Transfer Roll 26 with small diameter is preferred. The Media Web 33 makes a single pass transfer with Recording Transfer Roll 26A, or alternatively transfer with a corona wire, of the full color image with continuous fusing of the color image to prevent color contamination.

Figure 15:
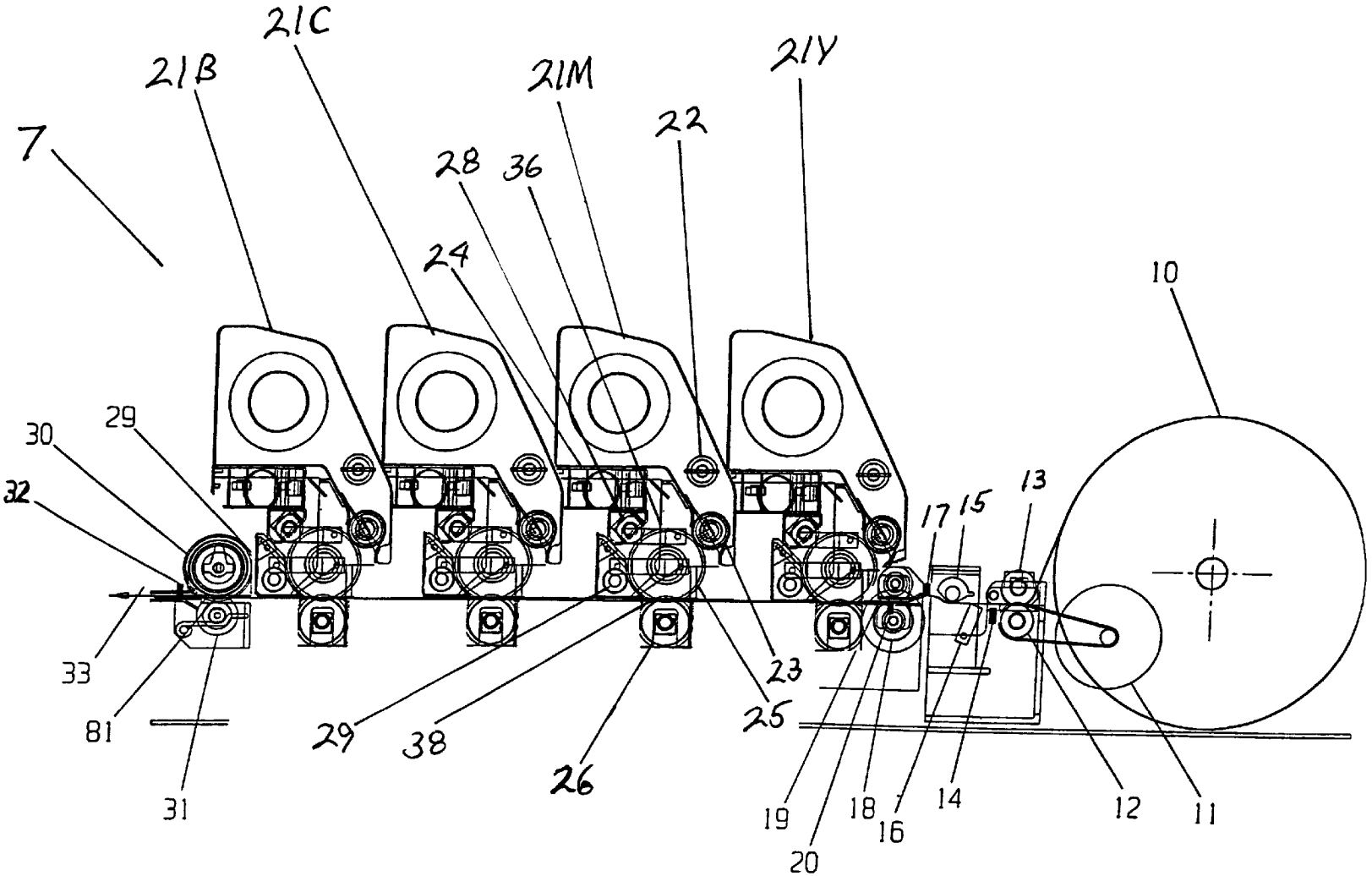
FIG. 15 is an explanatory diagram of a second preferred embodiment of an On Demand Serial Full Color Media Web Electrophotographic Printing Apparatus.

FIG. 15 shows a novel Compact Full Color Printer Apparatus 77 for media web printing. The unique EP Imaging Apparatus 7 may include the Registration Apparatus 6 shown in FIG. 1, providing precise serial parallel flat color registration for printing on the recording medium, or the Media Web 33. The EP Imaging Apparatus 7 comprises simple, compact mechanical precision alignment of closely spaced at least two or a multiple of serial color cartridges 21. Shown are four preferred colors for full color printing, namely, cartridges Yellow 21Y, Magenta 21M, Cyan 21C, and Black 21B respectively. The cartridges 21 are arranged in line side-by-side and parallel to each other, but each with a Transfer Roll 26, and each with a Photosensitive Drum/Transfer Roll Nip 38. These uniformly spaced cartridges 21 are commanded to print with simple desired time delay electronic control from Processor 51 to cause the four-color images to have precisely aligned registration with each the respective Transfer Roll 26 and Photosensitive Drum/Transfer Roll Nip 38. The four colors, as previously described, are laid down on the on the recording medium or Media Web 33 in serial or sequential fashion in a non-repeating process during a single pass of the recording medium or Media Web 33 relative to the cartridges Yellow 21Y, Magenta 21M. Cyan 21C, and Black 21B and the Media Web 33. Although, the Media Web 33 Registration Apparatus 6 shown in FIG. 1 is disclosed in FIG. [14] 15, any media handling method may be used for other media or recording medium; such as cut sheet, fan-fold, smart cards, or the like. On completion of image transfer as shown in FIG. [14] 15, the full color toned image is fused or bonded on the Media Web 33 as part of the printing process, whereby the Flash Fuser 91 shown in FIG. 13 may be used for high speed, non-contact, or the Pressure Roll Fuser 85 of FIG. 3 may be used for less expensive fixing for standard or narrow format printing. The basic EP imaging process may be substantially used for each color as described in FIG. 3. The present invention provides for high speed, sequential, or serial printing with a very compact, low cost, four color EP Imaging Printhead 7, having removable color cartridges or modules 21 printing with a time delay between them for continuous image forming. Precise registration with simple, low cost mechanical offsets between color cartridges or modules 21 of the EP Imaging Printhead 7 with the modules 21 placed side by side, closely spaced and parallel. Short, flat, straight, horizontal media or paper path, preferred with single pass printing, the four-color modules are mechanically synchronized with the positive feeding of the recording medium or Media Web 33. A Transfer Roll 26 with small diameter is preferred, or a corona wire, where the recording medium makes a single pass transfer of the full color image with continuous fusing of the color image to prevent color contamination.

Figure 16:
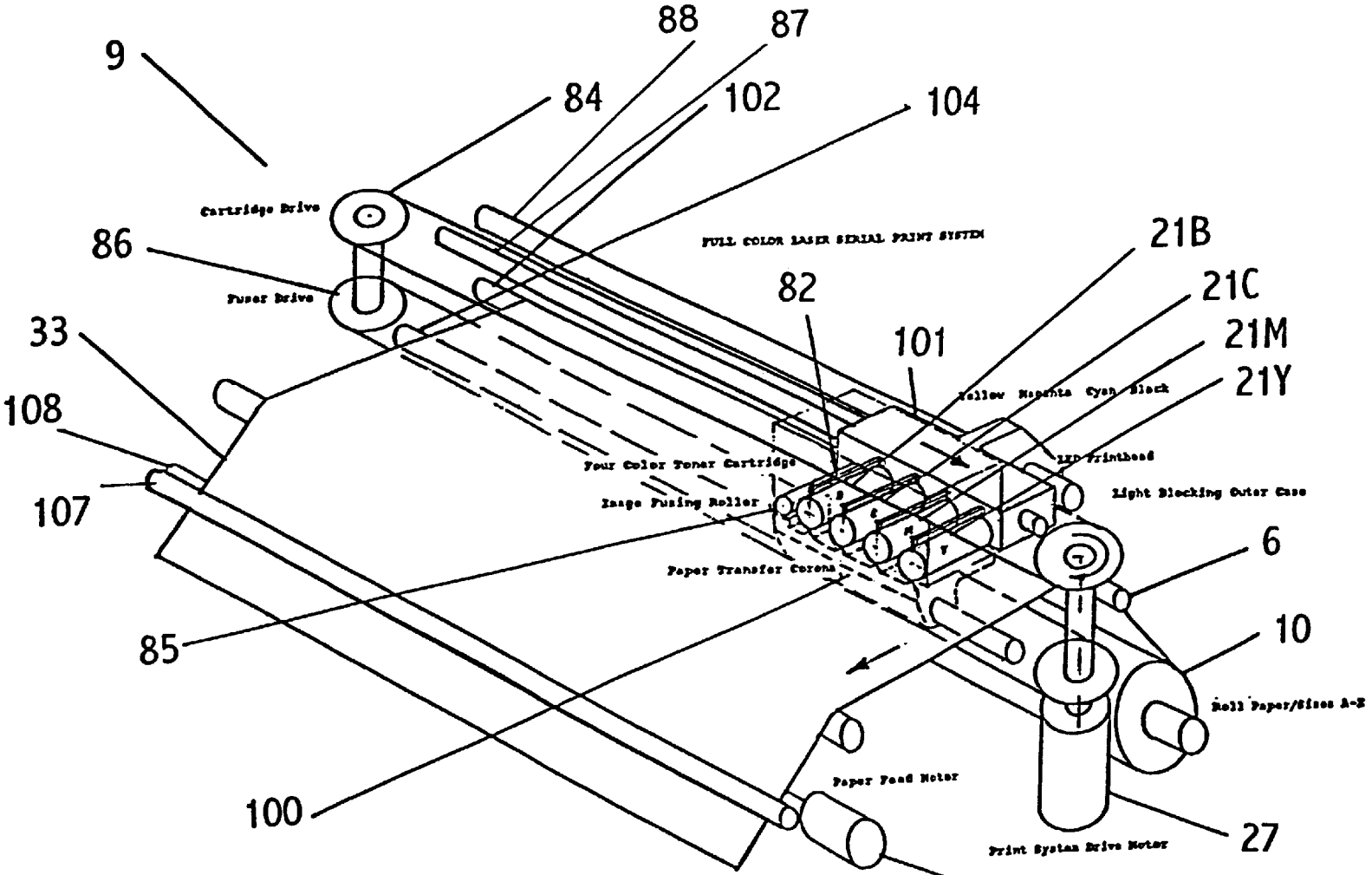
FIG. 16 is an explanatory diagram of a preferred embodiment of an On Demand Serial Full Color Traversing Electrophotographic Printing Apparatus.
Figure 17:
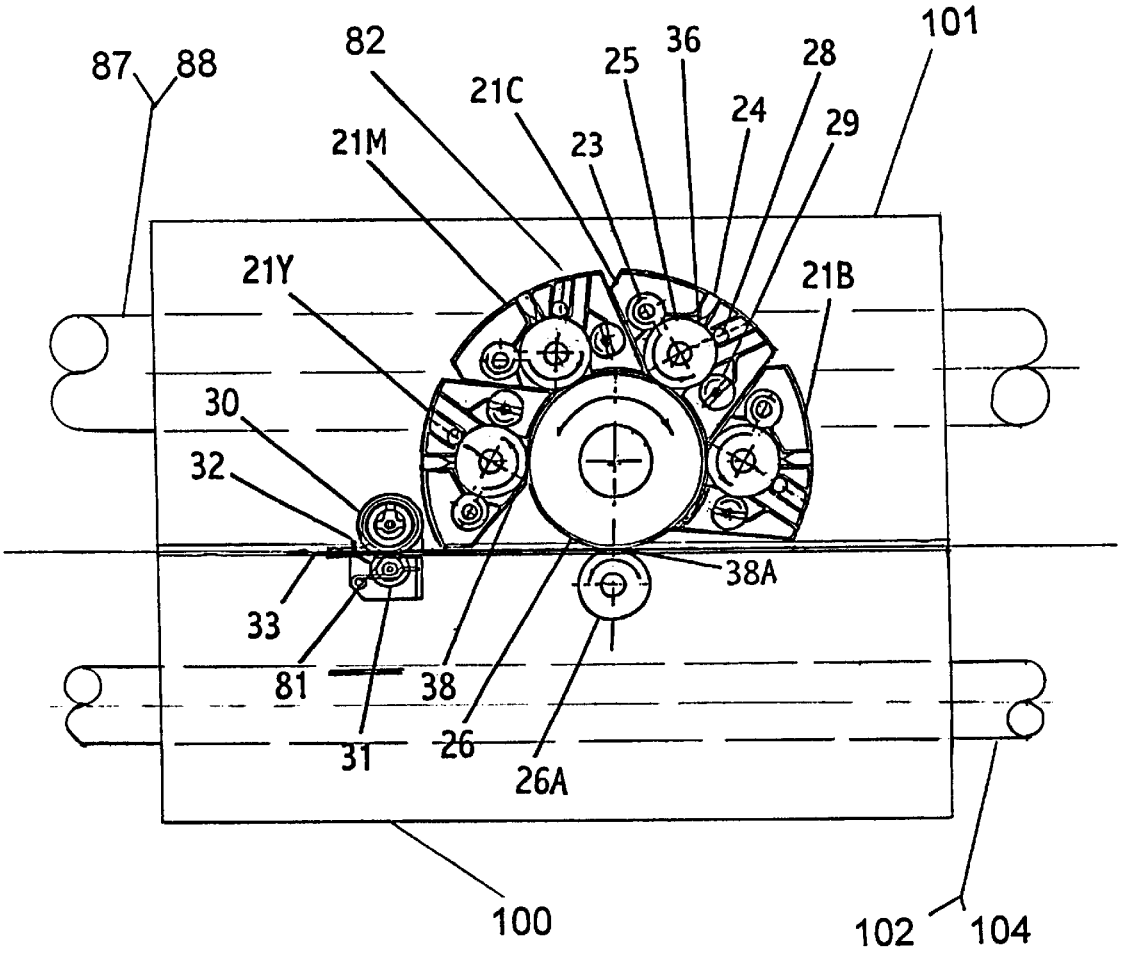
FIG. 17 is an explanatory diagram of a second preferred embodiment of an On Demand Serial Full Color Traversing Electrophotographic Printing Apparatus.

FIGS. 16 and 17 shows a novel Full Color Serial Traversing Electrophotographic Printer Apparatus 9 including a Full Color EP Serial Printhead 82, mounted on a Carriage 101, with a separate cooperating Image Transfer/Fuser Unit 100 located on the underside of the Media Web 33 for traversing said Media Web 33 with a predetermined print scan width. The Carriage 101 is supported and guided by parallel Transport Shafts 87 and 88, and parallel moving Image Transfer/Fuser Unit 100, including Pressure Roll Fuser 85, is supported and guided by separate parallel Transport Shafts 102 and 104. A Main Stepper Motor 27, synchronously at the same speed through a Carriage Belt Drive Unit 84 that is mechanically coupled to an Image Transfer/Fuser Belt Drive Unit 86, moves Carriage 101 and Image Transfer/Fuser Unit 100 in a main scan printing direction. This main scan printing direction of Full Color EP Serial Printhead 82 on Carriage 101 and the Image Transfer/Fuser Unit 100, which transfers and fuses the image while traversing perpendicular to the stopped Media Web 33. After each scan the Media Web 33 is advanced the predetermined scan width between the Carriage 101 and Image Transfer/Fuser Unit 100. Upon completion of each traverse print scan Full Color EP Serial Printhead 82 on the Carriage 101 and the Image Transfer/Fuser Unit 100, a setup is made for the next print scan, whereby Transport Rollers 107 and 108 are driven by the Main Feed Motor 106 advancing the Web 33 to the next scan position. Transport Rollers 107 and 108 and Transport Shafts 87 and 88, 102 and 104 are supported on both sides of the full color electrophotographic printing apparatus 9 side plates (not shown) along the media transport direction.

When each predetermined width print scan ends, the Media Web 33 is always advanced the predetermined width by the Transport Rollers 107 and 108 until the print job ends. After each print scan the Carriage 101 and Image Transfer/Fuser Unit 100 are traversed in the reverse direction by a Main Stepper Motor 27, and returned to a predetermined home position, ready to carry another print scan. The Carriage 101 may be lifted slightly for travel perpendicular to the recording medium in the reverse direction to avoid interference with the Media Web 33.

The Full Color Serial EP Printhead 82 as shown in FIG. 16 comprises simple, compact mechanical precision alignment of closely spaced plurality of serial color cartridges 21 as shown in FIG. 15. Disclosed are four preferred colors for full colored printing, namely cartridges Yellow 21Y, Magenta 21M, Cyan 21C, and Black 21B respectively. The cartridges 21 are arranged in line side-by-side and parallel to each other, but each with a Transfer Roll 26, and each with a Photosensitive Drum/Transfer Roll Nip 38. These uniformly spaced cartridges 21 are commanded to print with a simple desired time delay electronic control from Processor 51 to cause the four-color images to have precisely aligned registration with each the respective Transfer Roll 26 and Photosensitive Drum/Transfer Roll Nip 38. The four colors, as previously described, are laid down on the on the recording medium or Media Web 33 in serial or sequential fashion in a non-repeating process during a single pass of the recording medium or Media Web 33 relative to the cartridges Yellow 21Y, Magenta 21M, Cyan 21C, and Black 21B and the Media Web 33. The peripheral speed synchronized to the movement of the carriage.

The Full Color Serial EP Printhead 82 in FIG. 16 comprises the Full-Color Imaging Apparatus of FIG. 14 and FIG. 17 as a preferred embodiment of a simple, compact mechanical precision alignment of closely spaced plurality of serial color cartridges 21 as shown in FIG. 14, which may comprise six colors for high quality conventional photographs. Shown are four preferred colors for full color printing, namely cartridges Yellow 21Y, Magenta 21M, Cyan 21C, and Black 21B respectively. The cartridges 21 are arranged radially and parallel to each other around a common Tranifer Roll, each with a Photosensitive Drum/Transfer Roll Nip 38. These uiniformlny spaced cartridges 21 are commanded to print with a simple desired time delay electronic control from Processor 51 to cause the four-color images to have precisely aligned registration on said common Transfer Roll 26. The four colors, as previously described, are laid down on the common Transfer Roll 26 and subsequently on the recording medium or Media Web 33 by Recording Transfer Roll 26A at Recording Transfer Roll Nip 38A in a serial or sequential fashion in a non-repeating process during a single pass of the recording medium or Media Web 33 relative to the cartridges Yellow 21Y, Magenta 21M, Cyan 21C, and Black 21B and the Media Web 33. The peripheral speed synchronized to the movement of the carriage.

This unique Full Color Serial Traversing Electrophotographic Printer Apparatus 9 may include the on demand Registration Apparatus 6 shown in FIG. 1, providing precise registration for feeding and cutting the recording medium in the form of the Media Web 33, and/or a Compact Full Color EP Imaging Apparatus 7 may be utilized as shown in FIG. 14 or 15. On completion of image transfer as shown in FIG. 16, the full color toned image is fused or bonded on the Media Web 33 as part of the printing process, whereby the Flash Fuser 91 shown in FIG. 13 may be used for high speed, non-contact wide format, or the Pressure Roll Fuser 85 of FIG. 3 may be used for less expensive fixing for standard or narrow format printing. Alternatively, a simple cutter means (not shown) may be utilized after the completion of a print cycle, if the Carriage 101 is spaced close to the nip of Transport Rollers 107 and 108, and wherein said cutter is located after and close to said transport roller nip, such that the Desired Length Printout 45 is severed from the flat web with small leading and trailing margins to reduce media waste.

A cost advantage of the present serial full color traversing EP printing apparatus disclosed is a substantial reduction in printer memory required, since the footprint of the scan print array can be made narrower than the expanse of the recording medium. Also the cost of consumables and toner can be much less than ink jet. Since the scan width is larger than a serial ink jet printhead, the EP printhead can print about five times faster.

It is preferred to have the shortest distance between operating nips, the lowest melting point thermoplastic, or permanent toner with the most efficient, insulated fuser apparatus to grant the fastest warm-up at the lowest power consumption, the highest speed printing cycle with the most simple, reliable media feeding, handling and cutting Although the print process has been explained as an electrophotographic in the foregoing description of the embodiments, another printing, unit which transfers a toner image may also be used such as toner array imaging, thermo-magnetic, thermal-laser, electrostatic, and magneto graphic, or other technologies such as ink jet, and thermal transfer with on demand and continuous form rolls, fan-fold media, and cut sheets or cards The invention being thus described and illustrated, variations, modifications and equivalents will occur to those skilled in the art, and all these variations, modifications and equivalents are, intended to be within the scope of the invention, which is defined by the claims appended hereto. Conclusions, Ramifications, and Scope Accordingly, it can be seen that the present invention is a high reliable EP Media Web printer and Registration apparatus that reduces the media wastage overcoming the limitations of the prior art.

For some applications, recyclable media material may be preferred such as Lineless media media, as its name suggests, utilizes no liner backing. It commonly consists of continuous media with no perforations. Its top surface can be printed on; whereby it's reverse side contains a light adhesive. Thus, foregoing the need for the liner altogether. As an option, continuous roll 10 with an adhesive may be printed using non-stick Teflon coated components such as all lower feed rolls. These rolls may include media feed 12, registration 18, transfer 24, pressure 31, cutter 15, anvil 16 and ejection rolls 35.

The present invention is not limited to the above embodiments, but may be modified in various manners as follows. First, although the present invention has been explained as a printing apparatus, it may be a different type of image forming apparatus, such as a cut sheet or card stock printer, plastic card printer, copying machine or facsimile. Secondly, although the print process has been explained as an electrophotographic unit in the foregoing description of the embodiments, another printing unit which transfers a toner image may also be used such as toner array imaging, thermo-magnetic, thermal-laser, electrostatic, and magneto graphic. In addition, a low temperature toner may be utilized such as an encapsulated toner produced by interfacial polymerization and melts at a temperature of 80 deg. C. and not more than 120 deg. C.

The preferred Media Web compact embodiment would have the largest possible media roll, the smallest operating units, the shortest distance between the operating nips, the most efficient fuser apparatus to grant the fastest warm at the lowest power consumption, the lowest melting point thermoplastic or permanent toner, the high speed printing cycle with the most reliable media feeding, handling and cutting at the lowest cost.

Although the preferred Cutter 63 comprises a stationary apparatus including Knife Edge 15 and Anvil 16, a more complicated moving Cutter 63 can operate with the Media Web 33 in motion. One motion cutter (not shown) comprises a driven linear or oscillating Knife Edge and anvil unit that is accelerated to the same speed of the advancing Media Web 33, and rapidly and cleanly cuts the Media Web 33 at a desired distance from a fixed starting point such as a Media Feed Sensor.

Although the description above contains many specificities, these should not be construed as limiting the scope of the invention but as merely providing illustrations of some of the presently preferred embodiments of this invention. Various other embodiments and ramifications are possible within its scope standard and wide format as well as narrow format.

Thus the scope of the invention should be determined by the appended claims and their legal equivalents, rather than by the examples given.

What is claimed is:

1. An on demand compact media web electrophotographic printer for printing on industrial marking printouts such as labels, photos, narrow web receipts, tickets, tags, and the like, the improvement comprising a plurality of closely spaced unidirectional rapid print operating units for providing industrial marking printouts and means for cleanly cutting said media web and transporting said web leading edge forward to a registration means, means for forming a precise web buckle length at said registration means, means for print synchronization of said printout at said start of printing for receiving a toner image from a photosensitive means, means for scanning a latent image on said photosensitive means, means for cutting a media web trailing edge of a desired length printout prior to the completion of a print cycle, means for developing said latent image on said photosensitive means with toner means for transferring said toner image from said photosensitive means to said printout, means for fusing said transferred toner image to said printout, means for sensing said web buckle, means responsive to said sensing means for providing feedback to a processor wherein said processor with said feedback controls said closely spaced print operating units capable of producing precise printouts, thereby accurately, consistently, and productively processing said desired length printouts with reduced downtime and without media web waste.

2. The compact media web printer according to claim 1, wherein said sensing means monitors for said processor the control status of said print cycle, including an on-line operating setup of said media web cut leading edge and the forming of said precise web buckle, and wherein each time said print cycle is completed, the printer automatically online recalibrates and positions said cut leading edge of the web for the next print command, maintaining print registration accuracy and minimizing downtime and wasted printouts.

3. The compact media web printer according to claim 1, wherein said sensing means includes a web buckle sensor for detecting said precise web buckle, said web buckle sensor unaffected by the environment, and sensitive to the physical size and shape of the web buckle.

4. The compact media web printer according to claim 2, wherein said registration means comprises a registration roll feed unit with an upper registration roll and a lower registration roll forming a registration roll nip, said transporting of said cleanly cut web leading edge forward to said registration roll nip is performed by a media feed roll unit with an upper feed roll and a lower feed roll forming a feed roll nip, which transports said media web leading edge to said stopped registration roll unit nip and in combination with said sensing means, forms said precise web buckle repeatedly and reliably with each said on line operating setup.

5. The compact media web printer according to claim 4, wherein said registration unit includes a registration web guide for accurately guiding said media web leading edge, forming said precise web buckle with said registration web guide, and wherein the web buckle sensor constantly monitors said web buckle formed by said registration web guide during said on line operating setup.

6. The compact media web printer according to claim 1, wherein said processor monitors the precise buckle prior to cutting with said sensor means, and a Closed-Loop Control System controls accurate web feeding, cutting and locating of the desired web leading and trailing edges for label printing, detects label gaps or indicia, determines media or label spacing and registration, and defines a controlled minimum length web buckle with said sensing means to enhance productivity and further reduce label media wastage.

7. The compact media web printer according to claim 1, wherein a print process length has leading and trailing margin compensation such that each margin is determined to minimize wastage while maintaining said desired length printout.

8. The compact media web printer according to claim 1, wherein said means for toner development includes a toner developer roll unit and a photosensitive drum in a high capacity toner cartridge that concentrates said toner at a nip between said photosensitive drum and said developer roll.

9. The compact media web printer according to claim 7, wherein said processor controls a media feed stepper motor to precisely position label media and label edges utilizing a gap sensor, which measures the desired length of said label during a label media calibration process on a backer at the gap between the media web labels to locate the media gap with said media feed sensor.

10. The compact media web printer according to claim 1, wherein said closely spaced unidirectional rapid print operating units comprise a media web feed roll unit, a media registration roll unit, a photosensitive drum/transfer roll unit, and a toner fuser roll unit such that the distance between said units is about equal to the shortest printout.

11. The compact media web printer according to claim 1, wherein a clear media web reverse image print registration is controlled and maintained by said processor, whereby with each successive print command a print cycle starts with the completion of the on-line operating setup of said cut media web for laminating to a substrate such as an ID Card.

12. The compact media web printer according to claim 2, wherein said on-line operating setup occurs after each print job when a print synchronization means detects the desired length trailing edge, thereby stopping the registration roll feed unit.

13. The compact media web printer according to claim 6, said control system includes a registration roll nip sensing means for detecting the web cut leading edge prior to the start of forming, said precise web buckle.

14. The compact media web printer according to claim 6, wherein said control system includes a synchronization sensing means for detecting the web cut leading edge after the registration roll feed unit, thereby starting imaging on a photosensitive drum.

15. The compact media web printer according to claim 1, including advancing said media web until the web cut leading edge thereof engages a stopped registration roll nip, continuing the advance to form a precise web buckle, sensing the existence of said buckle at a predetermined degree of buckle, generating a signal in response to the sensing of said buckle indicating that the said edge of said cut media web leading edge has positively engaged the stopped registration roll nip.

16. The compact media web printer according to claim 1, wherein said closely spaced unidirectional rapid print operating units further comprise a media web feed roll nip, a media registration roll nip, a photosensitive drum/transfer roll nip, and a toner fuser roll nip, each comprising two operating rolls, such that the shortest distance between two adjacent said nips is minimized, and include knife edge of said cutting means cut position adjacent to said registration roller nip is also minimized, wherein said distance is equal to or slightly greater then the shortest printout.

17. The compact media web printer according to claim 1, further comprising a single pass serial electrophotographic color means; which includes a recording medium guide path, a plurality of compact, modular, color imaging development means, closely spaced in serial alignment, equally arranged in tandem, and aligned parallel to each other with a shared common transfer means; each imaging development means including said photosensitive means contacting said common transfer means at a nip between the photosensitive means and transfer means, wherein the uniformly offset imaging development means are commanded to print with a simple fixed time delay electronic control from said processor for causing the plural color images to align precisely on the common transfer means, wherein a final color toned image is transferred to said common transfer means; whereby said final color toned image is subsequently transferred to said recording medium against a recording transfer means at a nip between the common transfer means on said guide path in a serial transfer process controlled by the processor of said common transfer means and said recording transfer means in the single pass of the recording medium relative to said plurality of color imaging and development means, and wherein said fuser means fuses the final color toned image onto the recording medium.

18. The compact media web printer according to claim 1, further comprising a single pass serial electrophotographic color means; comprising a plurality of compact, modular, removable color imaging development means comprising cartridge units, closely spaced in serial alignment; said cartridge units, equally arranged, parallel to each other in a short, straight, horizontal media web guide path; each cartridge unit aligned with a unit transfer means comprising a roll and each cartridge unit including a photosensitive means comprising a drum contacting said unit transfer roll at a nip between the photosensitive drum and the unit transfer roll along the guide path; wherein the uniformly offset cartridges are commanded to print with a simple fixed time delay electronic control from said processor for causing the plural color images to have precisely aligned registration on the recording medium, wherein a final color toned image is sequentially formed from a plurality of electrostatic latent toned images corresponding with a plurality of predetermined colors respectively, and serially transferred unidirectional to said media web at a nip between each said unit transfer roll and respective photosensitive drum; wherein said continuous registration means precisely feeds the media web, and said cutting means severs the media web at said desired length printout, which includes said recording medium guide path, said plurality of compact, modular, color cartridge units, closely spaced in serial alignment, equally arranged in tandem comprising a plurality of compact, modular, removable color imaging development cartridge units, closely spaced in serial alignment; said cartridge units, equally arranged, parallel to each other in a short, straight, horizontal media web guide path; each cartridge unit aligned with a unit transfer roll and each cartridge unit including a photosensitive drum contacting said unit transfer roll at a nip between the photosensitive drum and the unit transfer roll along the guide path; wherein the uniformly offset cartridge units are commanded to print with a simple fixed time delay electronic control from the processor for causing the plural color images to have precisely aligned registration on the recording medium, wherein a final color toned image is sequentially formed from said plurality of electrostatic latent toned images corresponding with said plurality of predetermined colors respectively, and serially transferred unidirectional to said media web at said nip between each said unit transfer roll and said respective photosensitive drum; wherein the registration means precisely feeds the continuous media web and said cutting means severs the media web to said desired length printout produced by the registration means controlled by said processor, and wherein said fuser means comprising a fuser unit fuses the final color toned image onto said media web.

19. The single pass serial color printer of claim 12, wherein said single pass serial electrophotographic color means includes Yellow, Magenta, Cyan, and Black for full color printing, and said plurality of compact, modular, color imaging development means comprises four color electrophotographic removable cartridge units for the preferred four colors, wherein said shared common transfer means comprises a transfer drum contacting said tandem cartridge units closely spaced in serial alignment and equally arranged radially and equiangularly, parallel to each other about said common transfer roll; each cartridge unit including said photosensitive means comprising a drum contacting said common transfer roll at a nip between the photosensitive drum and said common transfer roll, wherein the uniformly offset cartridges are commanded to print with a simple fixed time delay electronic control from said processor for causing the plural color images to align precisely on the common transfer roll, wherein a final color toned image is transferred to said recording medium against a recording transfer roll at a nip between the common transfer roll on said guide path in a'serial transfer process during a continuous rotation controlled by the processor of said common transfer roll and said recording transfer roll in the single pass of the recording medium relative to said plurality of color cartridge units, and wherein a fuser unit fuses the final color toned image onto the recording medium.

20. The single pass serial color media web printer of claims 17 and 18, wherein the same basic color electrophotographic image development means including the process is substantially used for each color, wherein including said four colors and preferably six colors for printing the quality of traditional photographs.

21. The color printers of claims 17 and 18, wherein the fuser unit is a pressure roll fuser unit comprising a toner fuser roll against a pressure roll, thereby forming a nip with the recording medium fed by the nip for cost effective fusing and transporting of the desired length printout.

22. The color printers of claims 17 and 18, wherein the fuser unit is a flash fuser unit for higher speed, non-contact fusing.

23. The color printers of claims 17 and 18, wherein said industrial marking recording medium includes cut sheet, fan-fold, smart card, card stock or the like.

24. The single pass serial color printer of claims 17 and 18, includes an infeed media web registration apparatus, wherein the recording medium comprises a continuous media web; the registration apparatus for precisely feeding and cutting said media web to a desired length, wherein the desired length printout is produced by said registration apparatus controlled by said processor without media waste.

25. The compact media web printer according to claim 9, which includes a printed label peeling unit comprising a media vacuum label peeling roll for peeling an adhesive back media printed label from a backer after said print cycle and a backer vacuum peeling roll for peeling said backer from said media printed label.

26. The compact media web printer according to claim 1, wherein said means for fusing said toner image to said short printout comprises a toner flash fuser unit for said unidirectional toner fusing of said electrophotographic image, wherein said toner flash fuser unit is located after a photosensitive drum/transfer roll feed unit at a distance X after a photosensitive drum/transfer roll feed unit nip, and includes a means for ejection of said short printout from said printer.

27. The compact media web printer according to claim 1, such that said flash fuser including a core of a flash lamp is operated efficiently by a low cost power supply for use with a small narrow web label printer, wherein the voltage and capacitance of the discharge pulsed radiation energy is optimized for maximum efficiency, matching the absorption spectra of the toner image target area, and wherein the positioning of the core of the flash lamp for precise focusing of the radiation with top and bottom reflectors is forced repeatedly through the target area.

28. The compact media web printer according to claim 1, wherein at a print command from a host, the processor looks for a web buckle left formed for a prolonged period of time at a registration roll nip and if detected before said nip by a buckle sensor, a buckle forming error signal alerts an operator.

29. The compact media web printer according to claim 1, wherein when all errors are cleared on each print command from a host, and prior to a start of said print cycle, a media feed stepper motor accurately transports the web leading edge, detected by a stopped registration roll unit nip sensor, and forms a precise buckle as detected by a buckle sensor.

30. The compact media web printer according to claim 16, wherein said unidirectional photosensitive drum/transfer roll nip is located a distance V after said media registration feed roll nip, and wherein said toner fuser roll nip is located a distance X after said photosensitive drum/transfer roll nip, and wherein a print synchronization sensor is located a distance S after said media registration feed roll nip, and said print synchronization sensor is located a distance Y before said photosensitive drum/transfer roll nip, while said cutter knife edge is located before said media registration roll nip at a distance Z, a web buckle is set at a minimum length P, and said media feed roll nip, is located a distance Q before a media web sensor, and said cutter comprising an anvil with a knife edge cut position is located a distance W after said media web sensor, wherein said cutter is located after said web feed roll nip at a distance Q+W, and wherein the desired length printout, L equals (Z+P) plus a length R that can vary as desired to result in said total desired length. printout, and L=(Z+P)+R.

31. The compact media web printer according to claim 30, wherein for a label having a label gap on a backer with said gap detected by said media web sensor, a minimum cut label length between gaps equals Z+W+P, designed to be equal to or greater than the nip distances V, and X for transporting said minimum cut label length.

32. The compact media web printer according to claim 30, wherein for a continuous web printout, a minimum cut printout variable length equals Z+P, designed to be equal to or greater than the nip distances V, and X for transporting said minimum cut printout length.

33. The compact media web printer according to claim 30, wherein the photosensitive means comprises a drum with a diameter, D, about equal to 0.55 Inch, wherein Y equals about 0.85 inch, and wherein said printer is "palm size" with the shortest printout length under one inch.

34. The on demand compact electrophotographic printer according to claim 2, wherein said processor includes said on line operating setup for the most rapid, continuous web printer operation, whereby a web buckle is preformed and ready prior to the start of said print cycle by advancing a web leading edge a fixed distance Z, as detected by a registration roll nip sensor and an additional distance P. to: form a web buckle as detected by a web buckle sensor.

35. The on demand compact electrophotographic printer according to claim 2, wherein said processor includes an on line operating setup for the most rapid, continuous web printer operation, whereby a web buckle is preformed and ready, prior to the start of said print cycle by advancing the web cut leading edge to the stopped registration roll nip to form the web buckle as detected by a web buckle sensor, thereby at the start of said print cycle driving the registration roll feed unit synchronously with the media feed roll unit, while simultaneously starting the print imaging process.

36. The on demand compact electrophotographic printer according to claim 2, wherein said processor includes an on line operating setup for intermittent, or discontinues web printer operation, whereby prior to the start of said print cycle the web leading edge is advanced a fixed distance Z, as detected by a registration roll nip sensor, and upon a print command, the web leading edge is advanced an additional distance P to form a web buckle as detected by a web buckle sensor, thereby starting said print cycle, synchronously driving the media feed roll unit with a [the] registration roll unit, and simultaneously starting the print imaging process.

37. The on demand compact electrophotographic printer according to claim 2, wherein said processor includes an off-line automatic initial setup of a media roll which precisely cuts and positions media and label edges utilizing a media sensor by advancing the media web a distance W, stopping the media feed roll unit, and accurately cutting the media web automatically, at a midpoint of a label gap, or at an indicia mark, and removing or feeding the cut web end waste out of the printer.

38. The compact media web printer according to claim 6, wherein said processor controls a media feed stepper motor to precisely position label media and label edges utilizing a gap sensor, which measures the desired length of said label during a label media calibration process, utilizing a Piezoelectric Sensor which detects the thickness difference between a media gap backer and a media label.

39. The compact media web printer according to claim 6, wherein said processor controls a media feed stepper motor to precisely position label media and label edges utilizing a gap sensor, which measures the desired length of said label during a label media calibration process, utilizing a see-through Transmissive Media Pitch Sensor for use with a transparent backer, or to gauge label length for media with visible inter label through hole notches, or pre-punched holes.

40. The compact media web printer according to claim 6, wherein said processor controls a media feed stepper motor to precisely position label media and label edges utilizing a gap sensor, which measures the desired length of said label during a label media calibration process, utilizing a Reflective Media Pitch Sensor, wherein said reflective sensor emits light, which is reflected back to said sensor when it reaches a black mark appearing on the front or reverse side of said printout, located as a repeating I-mark with a pitch distance on the rear of the backing media at the gap between adjacent media web labels.

41. The compact media web printer according to claim 40, wherein said processor controls a media feed stepper motor to precisely position label media and label edges utilizing a media feed sensor with continuous web media, which measures the desired length of said label during a label media calibration process, utilizing said reflective method of detection label desired black mark, or indicia, preprinted on the continuous plain web media such as on the backer, or on a front marking arrangement to define said desired length printout.

42. A color serial traversing printhead printer means including a color serial electrophotographic imaging unit; comprising a closely spaced plurality of serial color image development units; said image development units, equally arranged, radially and equiangularly, parallel to each other, and aligned parallel with a shared common transfer means; said serial electrophotographic imaging unit mounted on a carriage with a separate cooperating image transfer/fuser unit located for operating on the underside of a recording medium, and confronting the color serial imaging unit whereby the carriage is supported on and guided by parallel transport shafts, and the moving the image transfer/fuser unit is supported and guided by separate parallel transport shafts; wherein said transport shafts are supported on both sides of the color electrophotographic imaging unit with side plates along the media feed; the carriage and the separate transfer/fuser unit are driven synchronously at the same speed by a main stepper motor through a carriage belt drive unit mechanically coupled to an image transfer/fuser belt drive unit which moves the carriage and the image transfer/fuser unit in a main scan printing direction with a predetermined scan print width, whereby the image development means are arranged adjacent to and parallel to each other, but each with a photosensitive means, the uniformly spaced image development means are commanded to print with a simple desired time delay electronic control from processor to cause the plural color images to have precisely aligned registration with a common transfer means, wherein the complete final toned image on said common transfer means is transferred and fused onto the stopped recording medium; laid down on the recording medium in serial or sequential fashion in a non-repeating printing process during a single print scan of the stopped recording medium; the printing process and the printing direction are perpendicular to the recording medium; wherein at the end of each print scan the recording medium located between the carriage and image transfer/fuser unit is advanced the scan width for the next print scan by two media feed transport rollers driven by a media feed stepper motor, whereupon the completion of each traverse print scan, the carriage and unit are reversed, and returned to a home position and made ready for the next print scan.

43. A color serial traversing printhead printer according to claim 42, wherein their are four preferred colors for full color printing, namely yellow, magenta, cyan, and black respectively.

44. A color serial traversing printhead printer according to claim 42, wherein the carriage is lifted slightly for travel to the home position in the reverse direction to avoid interference with the recording medium.

45. A color serial traversing printhead printer according to claim 42, wherein said single pass serial color electrophotographic imaging unit, with recording medium guide path, said imaging development means comprises a plurality of compact, modular, removable color imaging development cartridge units, closely spaced in serial alignment; said cartridge units, equally arranged, radially and equiangularly, parallel to each other, and aligned parallel with said common transfer means comprising a shared common transfer roll; each cartridge unit including a photosensitive drum adjacent to said common transfer roll at a transfer zone between the photosensitive drum and transfer roll; wherein the uniformly offset cartridges are commanded to print with a simple fixed time delay electronic control from the processor for causing the plural color images to align precisely on the common transfer roll, wherein the final color toned image is transferred to said common transfer roll; whereby said final color toned image is subsequently transferred to said recording medium against said recording transfer roll at a transfer zone between the common transfer roll on said guide path in a serial transfer corona process during a continuous rotation controlled by the processor of said common transfer roll and said recording transfer roll in the single pass of the recording medium relative to said plurality of color cartridge units, and wherein a fuser unit fuses the final color toned image onto the recording medium.

46. A color serial traversing printhead printer of claim 42, wherein a simple cutter means is utilized after the completion of a media web short printout, such that a media feed transport roller nip is located immediately after the cartridge imaging unit for precisely post positioning said printout and wherein said cutter is located immediately after said transport roller nip, such that the desired length short printout is severed from the flat web with small leading and trailing margins to reduce media waste.

47. An improved method of printing on industrial marking printouts such as labels, photos, narrow web receipts, tickets, tags, and the like with closely spaced operating units of the type wherein an image is formed by an imaging member and a print medium is presented to the imaging member to transfer the image thereto and produce a print wherein the method is characterized by the steps of:

providing said medium as a continuous web of material for industrial marking printouts, driving the web with a first driver along an infeed path past a cutter assembly to a second driver not operating, whereby a web buckle is formed at a position following the cutter assembly, upon detection of the buckle by a buckle sensor, separately driving said web synchronously along a print path with the second driver operating to present a portion of the web to the imaging member and receive an image transferred there from, and operating the cutter assembly to cut the web in coordination with a defined position of the imaging member, the cut being coordinated to produce a trailing edge of said portion between the first and second drivers such that the portion of the web driven by the second driver receives the -transferred image with the trailing edge of said portion without loss of web material.

48. An on demand compact electrophotographic unidirectional printer for industrial marking on a short printout typically from one to under about four inches, such as a label, photo, ticket, receipt, RFID tag, ID card, and the like, the improvement for performing an on line operating setup of normal printer operation prior to each print cycle, comprising a plurality of closely spaced unidirectional rapid print operating units for transporting and print processing the shortest allowable printout, wherein said closely spaced print operating units further comprise a media registration roll feed unit, a photosensitive drum/transfer roll unit, and a toner fuser roll unit, each comprising two operating rolls thereby forming nips, such that the shortest distance between said two adjacent nips is minimized to accommodate the transport of said shortest printout, with means for transporting said short printout leading edge forward and registering at a registration roll nip, means for print synchronization of said short printout leading edge after said registration roll nip, with the start of scanning a latent image on a photosensitive drum, means for developing said latent image on said photosensitive drum with toner means for receiving a toner image from said photosensitive drum means for transferring said toner image from said photosensitive drum to said short printout, means for fusing said transferred toner image to said short printout, means for sensing a small deflection in said short printout, means responsive to said sensing means for providing feedback to a processor for control of said on line operating setup, wherein said feedback control positively registers said short printout, thereby minimizing media jams and wasted media.

49. The compact electrophotographic printer according to claim 48, further including a web feed and cut mechanism for registering short flat printouts from a roll with said small deflection sensor, wherein the distance between the cutter knife edge and the registration roll nip accommodates the shortest allowable flat printout.

50. The compact electrophotographic printer according to claim 48, wherein said feedback means for said processor includes said sensor means having a registration roll nip sensor for detecting said leading edge of said printout before said registration roll nip and a synchronization sensor for detecting the printout leading edge passing through the registration roll feed unit, thereby starting the imaging unit.

51. An on demand compact electrophotographic unidirectional printer for industrial marking on a short printout according, to claim 48, wherein said processor includes an on line operating setup to perform the most simple and reliable print cycle,cutting and printing the same predetermined length short printout continuously, whereby the length of the buckle is minimized as detected by the buckle sensor, performing only to insure that the short printout leading edge is positively engaged at the registration roll feed unit nip for transporting said short printout.

52. A method for printing on industrial marking printouts such as labels, photos, narrow web receipts, tickets, tags, and the like, wherein on a print command from the host and during a print engine readiness, preparing for a start of a print cycle with the steps of transporting unidirectional with a web feed roll unit, a clean cut media web leading edge for a first predetermined distance to a nip of a stopped registration roll unit and performing a precise web buckle, sensing said web buckle with a buckle sensor, thereby controlling said start of said print cycle with a processor, synchronizing with a start of a latent imaging means, and simultaneously transporting said media web along a path synchronously with said web feed roll unit and said registration roll unit, while maintaining said precise web buckle ahead of a cutter, and transporting said media web along said path into said latent imaging means comprising a photosensitive drum and transfer roll nip located at a second predetermined distance after said media registration feed roll nip.

53. A color serial traversing printhead printer for industrial marking on a short printout in a single pass of said traversing printhead, including a compact, narrow format, color serial electrophotographic imaging unit; wherein said unit comprises precision alignment of a closely spaced plurality of serial color cartridges, said color serial imaging electrophotographic unit mounted on a carriage with a separate cooperating image transfer/fuser unit located for operating on the underside of said short printout and confronting the color serial imaging unit, whereby the carriage is supported on and guided by parallel transport shafts, and the moving the image transfer/fuser unit is supported and guided by separate parallel transport shafts; wherein said transport shafts are supported on both sides of the color electrophotographic printing unit with side plates along the short printout feed direction; the carriage and the separate transfer/fuser unit are driven synchronously at the same speed by a main drive motor through a carriage belt drive unit mechanically coupled to an image transfer/fuser belt drive unit which moves the carriage and the image transfer/fuser unit in a main scan printing direction with a predetermined scan print width preferably equal to the length of the short printout, whereby the cartridges are arranged adjacent to and parallel to each other in a radial array with a common transfer roll, or an inline array each with a transfer roll, the uniformly spaced color cartridge units are commanded to print with a simple desired time delay electronic control from the processor to cause the plural color images to have precisely aligned registration; wherein the complete toned image is transferred and fused onto the stopped short printout in serial or sequential fashion in a non-repeating printing process during a single print scan over the stopped short printout; the printing process and the printing direction are perpendicular to the stopped short printout; wherein at the end of each stopped short printout cycle; the scan width for the next print scan by two short printout feed transport rollers driven by a media feed stepper motor, whereupon the completion of each traverse print scan, the carriage and unit are reversed, and returned to a home position and made ready for the next printout.

54. The compact media web printer according to claim 1, 48, and 52 comprising a color printer wherein there is a plurality of said means for developing said latent image on said photosensitive means with said toner and a plurality of said means for transferring said toner image from said photosensitive means to said printout.

55. The compact media web printer according to claim 54, wherein said plurality of said image development means includes four color electrophotographic closely spaced unidirectional operating units for full color printing, namely Yellow, Magenta, Cyan, and Black respectively.

56. The compact media web printer according to claims 1 and 68 wherein said sensing means includes a web buckle sensor for detecting a precise web buckle, wherein said web buckle sensor comprises a proximity sensor which functions electro-optically and controls the forming of said web buckle by interrupting a light beam between an emitter and receiver.

57. The compact media web printer according to claim 56, wherein said proximity sensor is of two reflective types: straight or flared through beam, and whereby a flared fiber optic sensor interacts more sensitively to the location of the surface of the web buckle.

58. The compact media web printer according to claims 1 and 52, wherein a proximity sensor, functions acoustically and controls the forming of said web buckle, which is sonic or ultrasonic that measures a distance between the sensor and the web buckle.

59. The compact media web printer according to claims 1 and 52, wherein a proximity sensor, functions electromechanically and controls the forming of said web buckle with an electro-mechanical limit switch such as a micro switch that is actuated by contact with the media web during the formation of said web buckle.

* * * * *